US005685190A

United States Patent [19]

Yamamoto et al.

[11] Patent Number: 5,685,190

[45] Date of Patent: Nov. 11, 1997

[54] EXPANDING MANDREL, EXPANDING METHOD AND EXPANDING APPARATUS USING THE EXPANDING MANDREL AND HEAT EXCHANGER WITH HEAT EXCHANGING TUBES EXPANDED BY THE EXPANDING METHOD

[75] Inventors: Yoshitaka Yamamoto; Shigemi Miwa; Isao Ogami; Noriaki Nakao; Takuro Katagami, all of Sakai, Japan

[73] Assignee: Daikin Industries, Ltd., Osaka, Japan

[21] Appl. No.: 392,817

[22] PCT Filed: Jun. 24, 1994

[86] PCT No.: PCT/JP94/01014

§ 371 Date: Feb. 27, 1995

§ 102(e) Date: Feb. 27, 1995

[87] PCT Pub. No.: WO95/00268

PCT Pub. Date: Jan. 5, 1995

[30] Foreign Application Priority Data

Jun. 25, 1993 [JP] Japan ..... 5-179847

[51] Int. Cl.[6] ..... B21B 25/00; B21D 9/03

[52] U.S. Cl. ..... 72/466; 72/75

[58] Field of Search ..... 72/75, 479, 466

[56] References Cited

U.S. PATENT DOCUMENTS

| | | | |
|---|---|---|---|
| 1,095,265 | 5/1914 | Brinkman | 72/75 |
| 2,545,878 | 3/1951 | Forrest | 72/466 |
| 3,831,413 | 8/1974 | Glatthorn . | |
| 4,671,096 | 6/1987 | Crosby, Jr. | 72/466 |
| 4,716,753 | 1/1988 | Martin . | |
| 4,727,744 | 3/1988 | Ferree | 72/466 |
| 4,736,613 | 4/1988 | Dailey | 72/479 |
| 4,876,871 | 10/1989 | Arzenti et al. . | |

FOREIGN PATENT DOCUMENTS

| | | | |
|---|---|---|---|
| 2220326 | 10/1974 | France . | |
| 2831833 | 1/1980 | Germany | 72/466 |
| 51-23466 | 7/1976 | Japan . | |
| 539700 | 6/1993 | Japan . | |
| 389862 | 7/1973 | U.S.S.R. | 72/479 |
| 1486216 | 6/1989 | U.S.S.R. | 72/75 |

*Primary Examiner*—David Jones

[57] ABSTRACT

An expanding mandrel (10) used mainly for expanding heat exchanging tubes (21) of a cross fin coil (20) of an air conditioning machine, so as to connect them to fins of the cross fin coil. The expanding mandrel has flexibilty, comprising a plurality of mandrel pieces (11) which are bandably connected in a row, with an expanding head (13) disposed at the leading end. By an expanding method and an expanding apparatus both using the mandrel (10), the mandrel (10) is wound on the winding drum (41); is fed from the winding drum (41) so as to be inserted into the heat exchanging tube (21) of the cross fin coil so as to be expanded at the time of tube expansion; and is retracted from the heat exchanging tube (21), after completion of the expanding, so as to be wound on the winding drum (41). This provides a decreased size of the apparatus and allows even an expansion of a heat exchanging tube which has been bend-processed.

10 Claims, 18 Drawing Sheets

EXPANDING MANDREL, EXPANDING METHOD AND EXPANDING APPARATUS USING THE EXPANDING MANDREL AND HEAT EXCHANGER WITH HEAT EXCHANGING TUBES EXPANDED BY THE EXPANDING METHOD

This invention relates generally to Expanding Mandrels, An Expanding Method and An Expanding Apparatus using an expanding mandrel. It also relates to a Heat Exchanger with heat exchanging tubes which are expanded by disclosed expanding method.

BACKGROUND OF THE INVENTION

1. Technical Field

The present invention mainly relates to an expanding mandrel for fabrication of a cross fin coil for use in a heat exchanger of an air conditioning machine. It also concerns an expanding method and an expanding apparatus both of which employ the expanding mandrel.

2. Background Art

A cross fin coil for use in a heat exchanger of an air conditioning machine is fabricated by piercing a plurality of heat exchanging tubes through a plurality of fins and fixing the tubes to the fins by expanding the tubes.

A mechanical type expanding apparatus is used a lot for fabrication of a cross fin coil. A conventional mechanical type expanding apparatus is shown in FIGS. 22 and 23. Although the conventional expanding apparatus illustrated herein is of the horizontal type, an expanding process is carried out on the same principle in a vertical type expanding apparatus as well.

The conventional, mechanical type expanding apparatus (of horizontal type) comprises a horizontal bed 1; a movable frame 4 which makes back-and-forth motion between a pair of front and rear stationary frames 2, 3 disposed on the bed; and a plurality of mandrels 5, 5 . . . which are horizontally arranged between the stationary frames 2, 3, are connected at their basal ends to the movable frame 4 and are provided at their leading ends with expanding heads.

For expansion of a tube, a cross fin coil W to be expanded is fixed on the bed 1 in front of the stationary frame 2, first, and then the movable frame 4 is moved forwardly. The mandrels 5, 5 . . . are then advanced at a time, passing through the stationary frame 2, so that the expanding heads disposed at the leading ends of the mandrels are forcibly inserted into cooling tubes of the cross fin coil, so as to expand the cooling tubes simultaneously.

This conventional mechanical type expanding apparatus needs marginal spaces for pulling out the mandrels and increases in length. Generally, the conventional type apparatus is required to have a length fourth times as long as the whole length of the cross fin coil. Due to this, this conventional mechanical type expanding apparatus has disadvantage that the apparatus becomes large in size.

Besides, since the mandrels cannot be inserted into non heat exchanging tubes, there is a limitation in that a cross fin coil of L-shaped type or U-shaped type having heat exchanging tubes bent as shown in FIGS. 24 and 25 cannot be processed for expansion. Due to this limitation, in the case of the cross fin coil of the L-shaped type or the U-shaped type, before the cross fin coil undergoes a bending process, the tubes are expanded and fixed to the fins, and then the cross fin coil is bend-processed.

However, with this expansion work, there is a drawback that the fins are subjected to damage at the time of bending.

In addition, this work is difficult to apply to a multiple array of coils, because, in the multiple array of coils, inside and outside coils of which curvature radii are different must spaced apart from one another.

For solving these problems, a hydraulic type expanding apparatus has been proposed. The hydraulic type expanding apparatus is practically applied to large-sized cross fin coil having a whole length of more than two meters.

However, where this hydraulic type expanding apparatus is applied to the cross fin coil of the L-shaped type or the U-shaped type, work hardening has developed in the bent portions of the heat exchanging tubes, so that the bent portions are insufficiently expanded. Due to this, the heat exchanging tubes are not sufficiently secured to the fins at their bent portions, resulting in performance reduction of around 5%.

Moreover, since the alternative fluorocarbon is averse to water, more than anything else, it is difficult to introduce the hydraulic expanding apparatus for future use. Also, it is expected that the already-employed hydraulic type expanding apparatus will have to be replaced with a mechanical type expanding apparatus.

Hence, development of a small-sized expanding apparatus of the mechanical type applicable also to the bend-processed cross fin coil has been awaited.

SUMMARY OF THE INVENTION

It is an object of the present invention to provide an expanding mandrel which can be used for a mechanical expansion of a tube and can remarkably reduce a length of the apparatus.

It is another object of the present invention to provide an expanding method and an expanding apparatus which enable to reduce a length of an expanding apparatus, in spite of a mechanical type expanding apparatus, and also readily expand even an bend-processed cross fin coil, and a heat exchanger having heat exchanging tubes expanded by the expanding method.

An expanding mandrel of the present invention is a flexible expanding mandrel, comprising a plurality of mandrel pieces which are insertable into tubes to be expanded and are so connected to one another in a row as to bend at the connecting portions, with an expanding head disposed at the leading end thereof.

The flexible mandrel may be of universal type, as shown in FIGS. 1 and 2, in which the plurality of mandrel pieces 11, 11, . . . are formed of short rod-like members, and adjacent mandrel pieces 11, 11 are so connected to each other as to be flexible.

Alternatively, the flexible mandrel may be of rosary type, as shown in FIGS. 12 and 13, in which a plurality of mandrel pieces 11, 11 . . . are formed of spherical pieces having diametrically extending through-holes 11*a* through which a wire 14 is passed to connect the plurality of mandrel pieces 11, 11 . . . in a row.

In the mandrel 10 of the rosary type, as shown in FIG. 12, it is preferable that spacers, each of which has at the center a through-hole 15*a* for the wire 14 to pass therethrough and at the opposite ends spherical seats 15*b*, 15*b* for the mandrel 11, 11 to be in contact therewith on surfaces, are interposed between the adjacent mandrel pieces 11, 11.

The expanding method of the present invention is that a longitudinal thrusting force is applied to the abovementioned flexible mandrel from outside of the tube so as to forcibly push the expanding head at the leading end of the mandrel into the tube.

In the expanding method of the present invention, it is preferable to accomodate the flexible mandrel by winding it on a winding drum.

The expanding apparatus of the present invention includes the winding drum for accomodating the flexible mandrel by winding it thereon and a mandrel feeding mechanism for applying a longitudinal thrusting force to the mandrel from outside of the tube so as to forcibly push the expanding head at the leading end of the mandrel into the tube.

In one aspect of the expanding apparatus as disclosed herein, there is provided a work support on which the cross fin coil to be expanded is fixedly secured, and an expanding unit equipped with the winding drum and the mandrel feeding mechanism is reciprocatingly movable in arrangement directions of the tubes of the cross fin coil fixedly secured on the work support.

Preferably, the expanding unit is so designed as to synchronously operate a plurality of mandrels.

In another aspect of the expanding apparatus as disclosed, the expanding unit employs four mandrels, with feeding passages for the four mandrels being arranged at four apexes of a diamond shape.

Not only is the mandrel feeding mechanism attached to the winding drum, but the winding drum may function as the mandrel mechanism.

In a further aspect of the disclosed expanding apparatus, there is provided the mandrel feeding mechanism attached to the winding drum. The feeding mechanism comprises a mandrel guide for guiding the mandrel linearly; a pair of sliders which make synchronous reciprocating motion in the opposite directions along the mandrel guide by a pair of crank mechanism; and movable hitching pins which are provided at the sliders and are movable perpendicularly to the mandrel guide so as to fit into concaved portions at the mandrel pieces of the mandrel in the mandrel guide.

The universal type mandrel, comprising long mandrel pieces easy for the concaved portions to be formed therein, is suitable for the mandrel used with this structured apparatus.

In another aspect of the expanding apparatus, there are provided (i) a winding drum which has a spiral groove for winding therealong the mandrel and allows the mandrel wound along the spiral groove to be fed from a mandrel entrance/exit portion of the winding drum by the normal rotation thereof and the mandrel to be wound along the spiral groove by the reverse rotation thereof and (ii) a mandrel guide disposed at the mandrel entrance exit portion of the winding drum. The mandrel drum is provided around its outer peripheral portion with a sheath for covering a spiral -groove region except the mandrel guide.

Preferably, the sheath is supported to be rotatable together with the winding drum. Further, the rosary type mandrel comprising spherical mandrel pieces is suitable for the mandrel applied to the expanding apparatus mentioned immediately above.

Also, it is preferable that the winding drum is provided with (i) a stopper engageable with an end portion of an array of mandrel pieces of the rosary type mandrel wound around the spiral groove and (ii) a resilient member for pulling an end of the wire passed through an array of the mandrel pieces to bring the end portion of the array of the mandrel pieces into resilient contact with the stopper.

Further, it is preferable that slide bases supporting the winding drum, the sheath and the mandrel guide are so supported as to make reciprocating motion in the axial direction of the winding drum with respect to a basal support and are provided with a driving mechanism for moving the slide bases forwardly and backwardly at certain pitches.

Further, the present invention is characterized by a heat exchanger having heat exchanging tubes expanded by the abovementioned expanding method.

The function and effects of the expanding mandrel having the abovementioned construction, the expanding method and apparatus using this expanding mandrel, and the heat exchanger having heat exchanging tubes expanded by the expanding method will be explained hereinafter.

Firstly, in the case of the expanding mandrel of the present invention, when a longitudinal thrusting force is applied to the mandrel from, for example, the outside of heat exchanging tubes of cross fin coil, the thrusting force is transmitted to the expanding head at the leading end of the mandrel, so that, in spite of the mandrel having flexibility, the expanding head is forcibly pushed into the tube to expand it. In addition, the mandrel can be wound up by virtue of its flexibility, so that length of the mandrel equipment is reduced. Furthermore, since the mandrel can pass through bent portions of heat exchanging tubes which have been bend-processed, it can extend through the cross fin coil which has been bend-processed.

Among others, the rosary type mandrel, employing the spherical mandrel pieces, can smoothly bend along curvatures of the heat exchanging tube and can readily expand even a tube with a small radius of curvature. Thus, it is especially suitable to an expanding process of the bend-processed cross fin coil. Also, since a plurality of mandrel pieces are connected in series by the wire, the expanding head can be readily replaced with another one having a different diameter.

In the rosary type mandrel, where the spacers are interposed between adjacent mandrel pieces, although the respective mandrel pieces are formed of spherical members, the respective mandrel pieces can be connected in series, with their contacted with each other on surfaces. This provides the results that partial wears and tears of the respective pieces are restrained, and the thrusting force applied from outside is efficiently transmitted to the expanding head to expand the heat exchanging tube having bent portions efficiently.

Further, since the expanding method and the expanding apparatus are of the mechanical type using the mandrel, uniform expanding process can be performed without influence of the heat exchanging tubes processed condition, hardness and the like, and also accomodation to changeovers to alternative fluorocarbon can be made without any problem. Moreover, since the mandrel has flexibility in spite of the mechanical type, the whole length of the apparatus can be extensively reduced by taking up the mandrel, while also the mandrel is applicable to the L-shaped or the U-shaped cross fin coil which has been bend-processed.

In the expanding apparatus set forth herein, since there is provided the expanding unit movable in arrangement directions of tubes of the cross fin coil to be expanded, the heat exchanging tubes of the cross fin coil fixedly secured on the work support can be expanded by unit numbers by intermittently driving the expanding unit. Therefore, the expanding working can be carried out effectively, and the expanding unit can be reduced in size.

In an aspect of the expanding apparatus herein, by selectively using two upper and lower mandrels and two left and right mandrels among four mandrels disposing discharging passages at four apexes of the diamond shape, several kinds of hairpin-shaped heat exchanging tubes having straight portions spaced apart from each other at different intervals can be expanded. Also, this apparatus can be readily applied to the hairpin-shaped heat exchanging tubes different in arrangement pattern, by using two mandrels aligned obliquely.

Thus, since this expanding apparatus can accomodate to several different kinds of and several different arrangement patters of heat exchanging tubes, a cost of the apparatus can be reduced and labor required for changeovers can be saved.

The "hairpin-shaped heat exchanging tube" used here means a heat exchanging tube bent at the middle portion in the U-like shape and comprising a pair of straight portions and a U-shaped portion. Several different types of the hairpin-shaped heat exchanging tubes different in the distance between the straight portions are used. Further, it is the straight portions of the hairpin-shaped heat exchanging tube that are to be expanded, and the U-shaped portion thereof, located at the outside of an outermost fin, is not expanded.

In one aspect of the expanding apparatus as set forth, a hitching pin at a forwardly-moving slider of the pair of sliders, which are synchronously moved in the opposite directions, is fitted into a concaved portion of the mandrel piece, and a hitching pin at a backwardly-moving slider is disengaged from a mandrel piece, so that the mandrel can always receive an advancing force from either of the sliders, so as to continue the advancing movement. The hitching pins can be set not to be brought into engagement with the mandrel piece, so as to maintain the mandrel in the stopped condition.

Thus, the synchronous motion of the pair of the sliders and the hitching pins provided thereat allows the wound mandrel to be fed constantly with simply mechanism and facilitates accomodation to the selective use of mandrels.

In an aspect of the expanding apparatus set forth herein, the mandrel wound along the, spiral groove is forcibly fed from the mandrel guide to the heat exchanging tube by the normal rotation of the winding drum. Hence, no special feeding mechanism is required, and the whole construction of the apparatus is simplified by that amount.

In addition, since the sheath is disposed around the outer peripheral portion of the winding drum, the mandrel wound along the spiral groove is prevented from an outward deviation at the time of feeding the mandrel and a rotative force of the winding drum is effectively converted into a feeding force for the mandrel, thus achieving an effective expansion of tube.

By the winding drum being reversely rotated, the mandrel which has finished expanding the tube can be accomodated along the spiral groove to save space and get ready for the next tube expanding to improve workability.

Further, by this expanding apparatus being used with the rosary type mandrel comprising a plurality of spherical mandrel pieces, even the heat exchanging tube bent in L-shape or U-shape can be readily expanded.

Also, by the sheath being rotated together with the winding drum, the mandrel can be fed from the winding drum and wound thereon, with less resistance, so that the winding drum is rotated with a small loss of driving power, thus providing an improved operation efficiency.

Further, by the winding drum being provided with a stopper engageable with the end portion of the array of the mandrel pieces in the rosary type mandrel; a fixing member for fixing the end portion of the wire; and a resilient member attached to the fixing member, plays of the respective pieces of the mandrel can be eliminated to hold the whole of the mandrel in a tense condition. This provides a good expanding operation by use of the expanding head and also allows the mandrel, when passing through bent portions of the L-shaped or U-shaped heat exchanging tube, to be smoothly moved while bending in accordance with the curvature radii of the bent portions, so as to effectively expand the cross fin coil having the bent portions.

Further, by the slide base, which supports the winding drum, the sheath and the mandrel guide, being forwardly moved in the axial direction of the winding drum with respect to the basal support at certain pitches so as to expand the cross fin coil having a plurality of heat exchanging tubes, the tubes can be expanded continuously and efficiently to provide an improved workability. Further, in the heat exchanger having the heat exchanging tubes expanded by the aforementioned expanding method, not only the straight heat exchanging tubes but also the L-shaped or U-shaped bent tubes can be connected tightly to the fins to effectively increase the heat exchanging area, so as to achieve a high-quality heat exchanger.

DETAILED DESCRIPTION OF PREFERRED EMBODIMENTS

Figure 1:
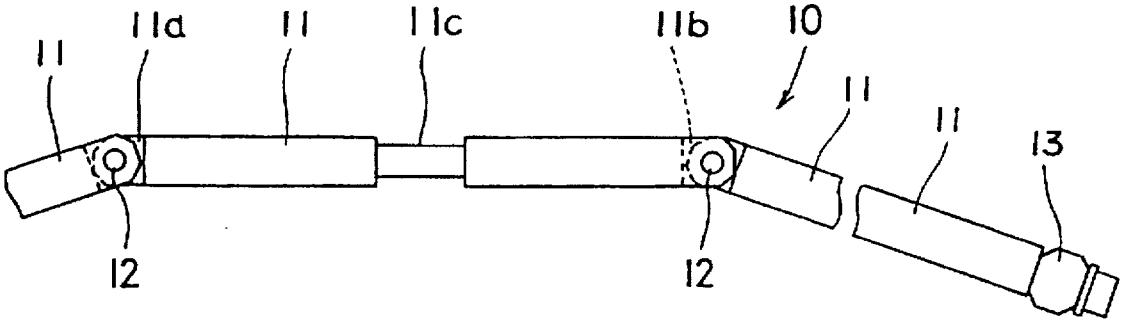
FIG. 1 is a side view showing a portion of a first embodiment of an expanding mandrel according to the present invention.

A first embodiment of an expanding mandrel of the present invention will be explained with reference to FIGS. 1 and 2.

A mandrel 10 illustrated herein is of the universal type, comprising a plurality of mandrel pieces 11 which are formed of small-diameter, round rods and are axially connected. Each mandrel piece 11 is provided at its one end with a plate-like lug 11*a*. The lug 11*a* is fit into a concaved portion 11*b* formed at the other end portion of an adjacent mandrel 11. The mandrel pieces are connected at the fitting end portions by pins 12 perpendicular to the lug 11*a* so as to pivot in both directions. Thus, the mandrel 10 can freely flex in a plane perpendicular to the pin 12 to be wound up. Further, by consideration of a dimension of the mandrel piece 11, the mandrel 10 can pass through bent portions of heat exchanging tube of a cross fin coil to be expanded.

Figure 2:
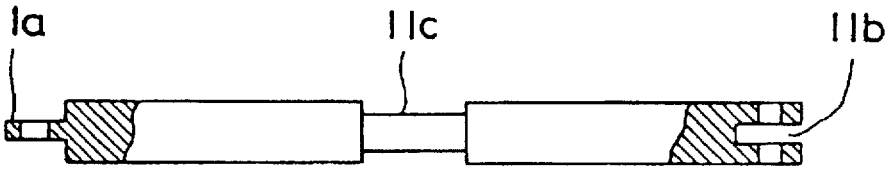
FIG. 2 is a plan view partially in section showing one of mandrel pieces of the mandrel.

As shown in FIG. 1, an expanding head is attached to the leading end portion of the mandrel 10. The expanding head has an outer diameter larger than an inner diameter of a heat exchanging tube of the cross fin coil which is intended to be tube-expansion processed. On the other hand, each mandrel piece 11 has an outer diameter smaller than the inner diameter of the heat exchanging tube and is provided at its intermediate portion with concaved portions 11*c* to which a hitching pin, as will explained later, is engageable and which are formed at four circumferencial positions of the mandrel piece.

A plurality of mandrels 10 of this universal type are inserted into the heat exchanging tubes of the cross fin coil simultaneously or orderly. The expanding heads 13 at the leading ends of the mandrels are forcibly pushed into the tubes, so as to expand the tubes and fix them to the fins.

Each mandrel 10 can freely flex in a plane perpendicular to the pin 12 to be wound up, so that large space for pulling out the mandrel is not necessary and the whole length of the apparatus can be remarkably reduced. The mandrel is directly inserted into the tube from the wound state by applying an axial force thereto from outside of the tube. Further, it can pass through the bent portion of the bend-processed heat exchanging tube also, so that it is applicable to the cross fin coil which has been bend-processed.

Figure 3:
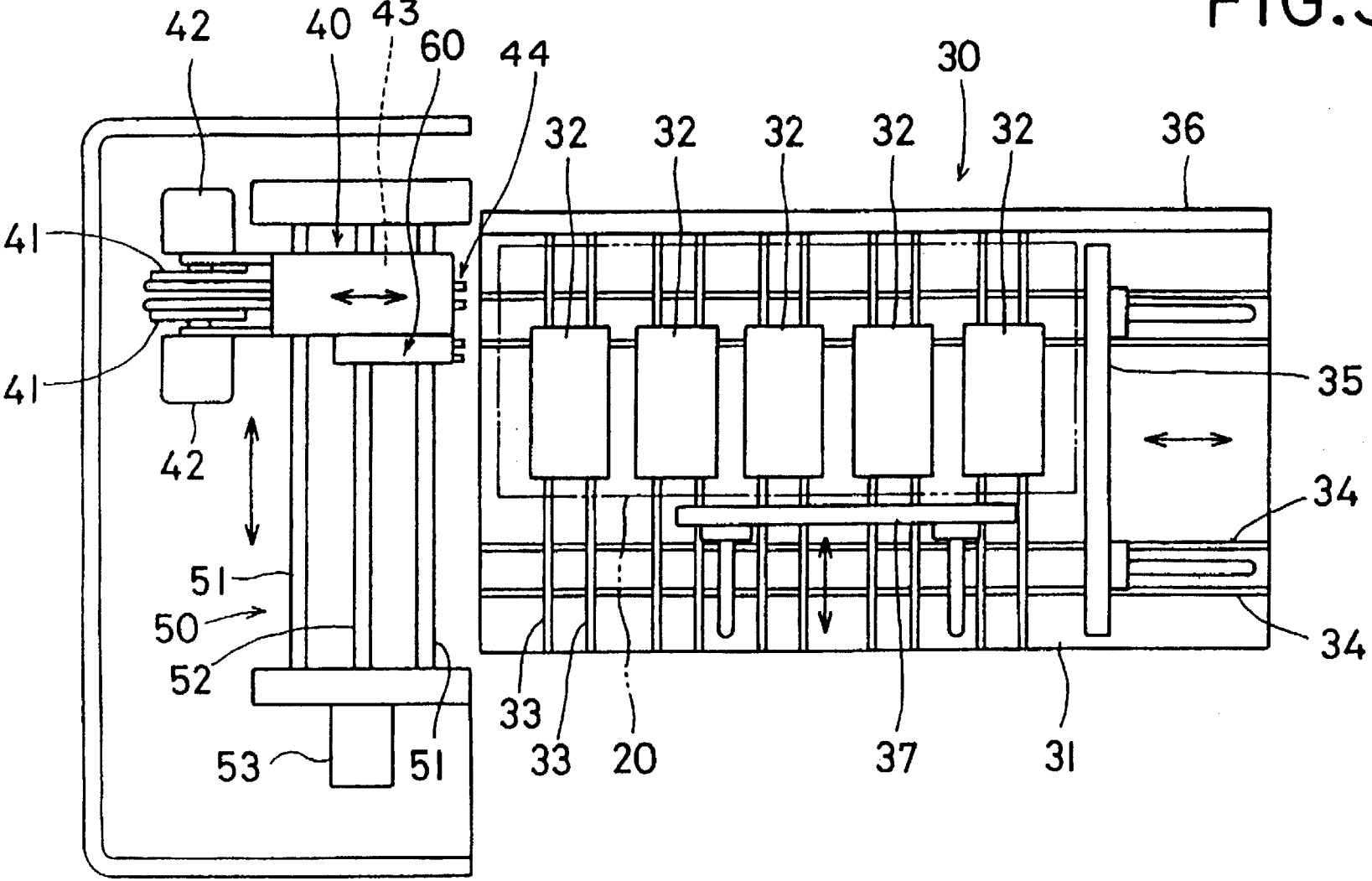
FIG. 3 is a plan view showing the whole constitution of a first embodiment of an expanding apparatus according to the present invention.
Figure 4:
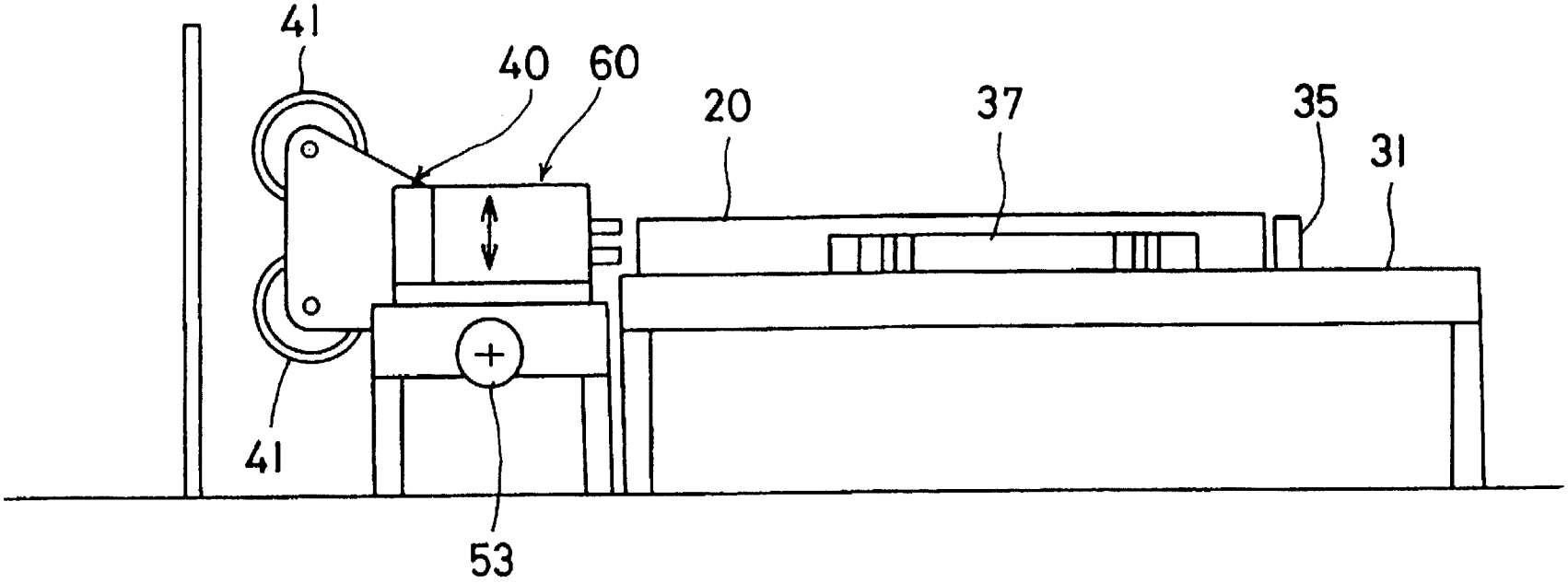
FIG. 4 is a side view of the expanding apparatus thereof.

Next, a first embodiment of an expanding apparatus employing the aforementioned mandrel will be discussed with reference to FIGS. 3 and 4.

The expanding apparatus illustrated herein is provided with a work support 30 on which the cross fin coil 20 to be expanded is fixed horizontally and an expanding unit 40 disposed at one end side of the work support 30.

The work support 30 includes a horizontal stationary support 31 and a plurality of movable supports 32 arranged on the stationary support 31. The movable supports 32 are guided by first guides 33 and are moved in the widthwise direction of the stationary support 31. The first guides 33 are guided by second guides 34 and are moved in the longitudinal direction of the stationary support 31. Thus, the movable supports 32 can move both in the widthwise direction and in the longitudinal direction of the stationary support 31, to be adjusted in position, in accordance with a dimension of the cross fin coil 20, so as to support fins of the cross fin coil 20 over a wide range, evading tube supporting plates thereof.

Further, on the stationary support 31 there are provided a positioning plate 35 and clamping plates 36, 37. The positioning plate 35 is movable in the longitudinal direction of the stationary support 31 to set the cross fin coil 20 in a suitable position on the stationary support 31 with reference to the one end thereof. One of the clamping plates 36 is fixedly secured to one side margin of the stationary support 31. The other clamping plate 37 which is opposed to the one clamping plate 36 is movable in the widthwise direction of the stationary support 31 to secure the positioned cross fin coil 20 between the clamping plates 36, 37. The cross fin coil 20 is secured, with the heat exchanging tubes being longitudinally aligned with the stationary support 31 and opening portions of the heat exchanging tubes facing one longitudinal end of the stationary support 31.

On one longitudinal side of the stationary support 31, there are provided an expanding unit 40 and a driving mechanism 50 therefor. The driving mechanism 50 includes guides 51, 51 and a screw 52 which are arranged widthwise of the stationary support 31, and drives the expanding unit 40 linearly in the widthwise direction of the stationary support 31 by rotation of the screw 52 driven by a motor 53. Further, the expanding unit 40 is driven up and down and back and forth by means of a mechanism which is not shown.

The expanding unit 40 employs four mandrels 10 of the universal type. The expanding unit 40 is provided at its rear portion with four winding drums 41 for winding the mandrels 10 individually. The winding drums 41 are driven individually by motors 42. The four mandrels 10 wound on the four drums 41 are fed forward one by one or by plurals simultaneously by a mandrel feeding mechanism 43 mounted to the drums 41.

Figure 5:
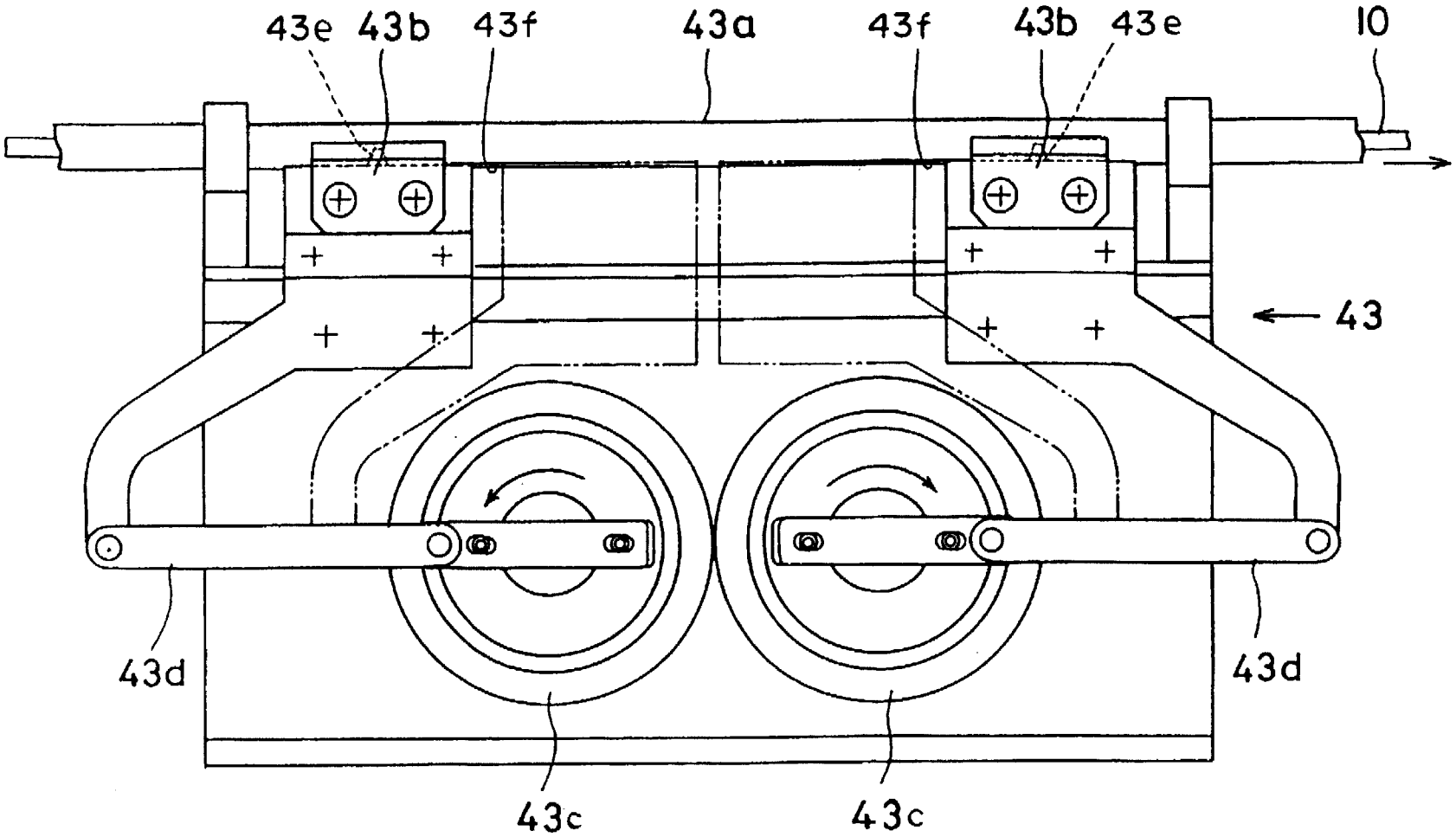
FIG. 5 is a plan view showing a slider driving section of a mandrel feeding mechanism.
Figure 6:
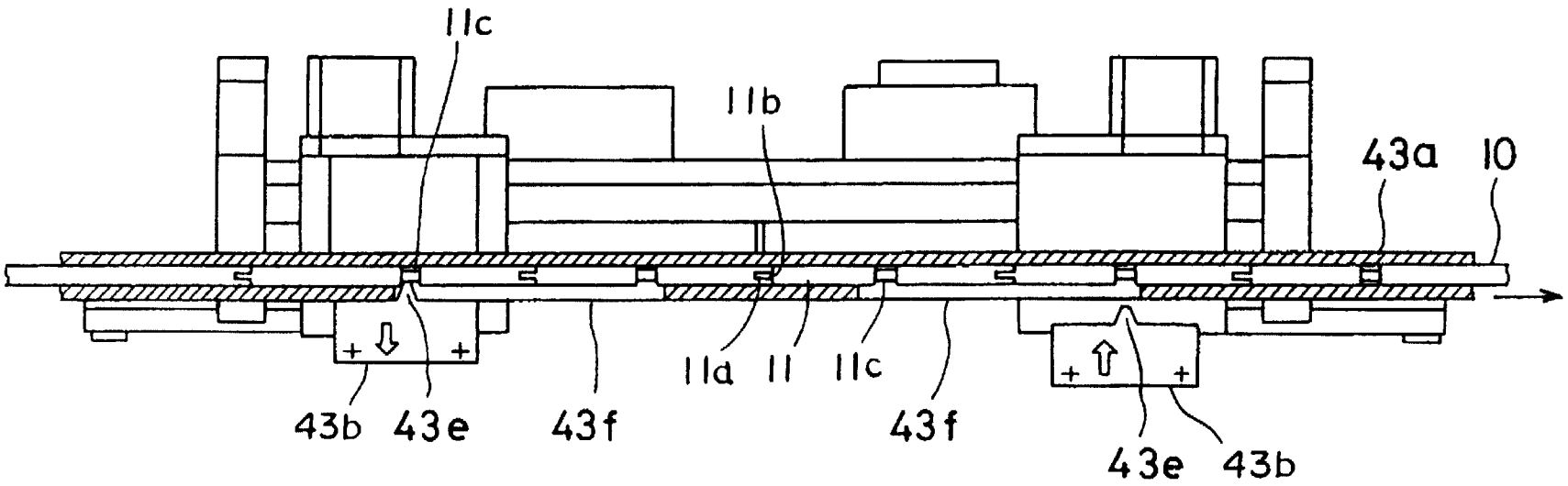
FIG. 6 is a side view partially in section of a mandrel guide of the mandrel feeding mechanism cut out to show a function of a hitching pin.
Figure 7:
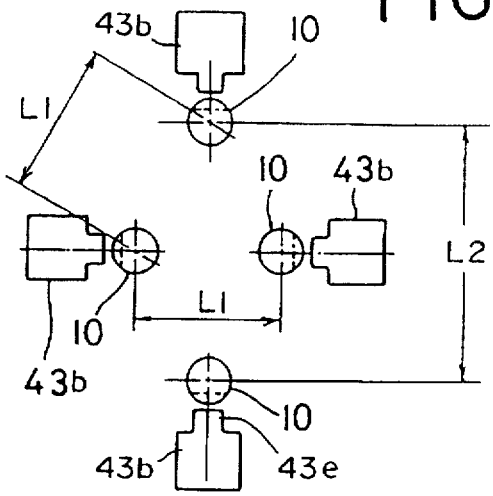
FIG. 7 is a schematic front view showing an arrangement of the mandrels.

One example of the mandrel feeding mechanism is shown in FIGS. 5 through 7.

The mandrel feeding mechanism 43 illustrated herein is disposed in front of the drums 41 shown in. FIG. 3 and includes, as shown in FIG. 5, a tubular mandrel guide 43*a* for guiding each mandrel 10 of the universal type, a pair of sliders 43*b*, 43*b* arranged along the mandrel guide 43*a*, and a pair of gears 43*c*, 43*c* for driving the sliders 43*b*, 43*b*.

The mandrel guide 43*a* is provided with a pair of opening portions 43*f*, 43*f* spaced apart from each other.

The gears 43*c*, 43*c*, meshing with each other, are rotated in the opposite directions synchronously by a common driving source. Crank arms 43*d*, 43*d* are connected at one end portions thereof to the gears 43*c*, 43*c* at the eccentric locations and at the other end portions thereof to the sliders 43*b*, 43*b*. When the gears 43*c*, 43*c* are rotated in the opposite directions, the sliders 43*b*, 43*b* are reciprocatingly moved in the opposite directions along the mandrel guide 43*a*. In other words, when one slider 43*b* is advanced, the other slider 43*b* is retreated, and vice versa, i.e., when the other slider 43 is advanced, the one slider 43*b* is retreated.

As shown in FIG. 6, the sliders 43*b*, 43*b* are equipped with hitching pins 43*e*, 43*e* respectively. The hitching pins 43e, 43e are reciprocatingly driven in the direction perpendicular to the mandrel guide 43a. The pins are brought closer to the mandrel guide 43a when the sliders 43b, 43b are advanced, while they are moved away from the mandrel guide 43a when the sliders 43b, 43b are retreated. With the hitching pins 43e, 43e brought closer to the mandrel guide 43a, their leading ends are inserted into guide portions through opening portions 43f, 43f formed in the mandrel guide 43a to be engaged to the concaved portions 11c of the mandrel pieces 11 of the mandrel 10 in the guide.

Thus, when the one slider 43b is advanced, the hitching pin 43e engages with the mandrel 10 to feed it forwardly, while, when the one slider 43b is retreated, the other slider 43b is advanced so that the mandrel 10 can be fed further forwardly by the other slider 43b.

Thus, the mandrel 10 is fed forwards constantly by the reciprocating motion of the sliders 43b, 43b in the opposite directions and the accessing and separating motion of the hitching pins 43c, 43c synchronizing with the reciprocating motion of the sliders. Travel of the sliders 43b, 43b is set to be the same as or a integral multiple of an interval between the concaved portions 11c, 11c of the mandrel 10. The opening portions 43f, 43f are made by slits longer than the travel of the sliders 43b, 43b.

In the embodiment mentioned above, four mandrels 10 of the universal type are used and so four mandrel guides are used correspondingly. These four mandrel guides 43a are arranged in such a manner that the mandrels 10 fed from the mandrel guides 43a are located at four apexes of a diamond shape, as shown in FIG. 7. A distance L1 between the left and right mandrels 10, 10 is set 25.4 mm, and a distance L2 between the upper and lower mandrels 10, 10 is set 44.0 mm.

A pair of sliders 43b, 43b are assembled to each of the four mandrel guides 43a. The four pairs of sliders 43b, 43b are synchronously driven by the aforementioned gears 43c, 43c used as a common power source. In the four pairs of sliders 43b, 43b, when the hitching pins 43e, 43e at the pairs of sliders 43b, 43b are operated in synchronization with the movements of the sliders 43b, 43b, as mentioned above, the four mandrels 10 are fed synchronously. On the other hand, when the hitching pins 43e, 43e of any pair of the sliders 43b, 43b are kept apart from the mandrel guide 43a, a mandrel 10 corresponding to the pair of the sliders 43b, 43b is kept in the stopped condition. Therefore, the four mandrels 10 can be selectively used for expanding heat exchanging tubes of three different kinds and five different patterns.

Specifically, one of the three kinds of applicable heat exchanging tubes is hairpin-shaped heat exchanging tube having straight tube portions spaced apart by 25.4 mm; another one is hairpin-shaped heat exchanging tube having straight tube portions spaced apart by 44.0 mm; and still another one is straight heat exchanging tube. Further, the first kind of hairpin-shaped heat exchanging tube has three different patterns, one of which is that the straight tube portions are connected to fins, with a plane passing through the centers of the straight tube portions running horizontally; two others of which are that the straight tube portions are connected to the fins, with the plane passing through the centers of the straight tube portions being slanted in the same direction at an angle 60°, 120° with respect to horizontal plane. The second kind of hairpin-shaped heat exchanging tube has one pattern which is that the straight tube portions are connected to the fins, with the plane passing through the centers of the straight tube portions being running vertically. Further, there is still one pattern which is that the heat exchanging tubes are straight. Thus, there are five patterns in total.

The heat exchanging tubes of these three different kinds and five different patterns can be expanded by selective use of the mandrels. The reason therefor is: that since the distance L1 between the left and right mandrels 10, 10 is 25.4 mm, these two mandrels 10, 10 can be used for expansion of the first kind of heat exchanging tube of the horizontal pattern; that since the distances L1 between the upper and the right, the upper and the left, the lower and the right, and the lower and the left mandrels 10, 10 are also set 25.4 mm, the upper and right mandrels, or the lower and left mandrels 10, 10 can be used for expansion of the first kind of heat exchanging tube of the 60° slanted pattern; that the upper and left mandrels, or the lower and right mandrels 10, 10 can be used for expansion of the first kind of heat exchanging tubes of the 120° slanted pattern; that since the distance L2 between the upper and lower mandrels 10, 10 is 44.0 mm, these two mandrels 10, 10 can be used for expansion of the second kind of heat exchanging tube of the vertical pattern; and that any one of the mandrels 10 can be used for expansion of the straight heat exchanging tube.

Figure 8:
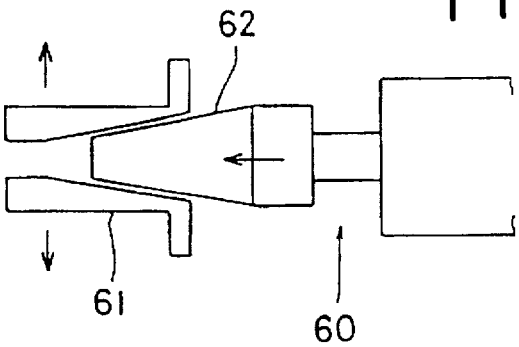
FIG. 8 is a schematic view showing a construction of a flaring machine.
Figure 9:
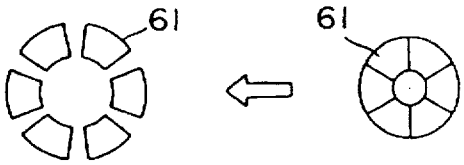
FIG. 9 is a schematic view of a sleeve of the flaring machine as viewed from the front.
Figure 10:
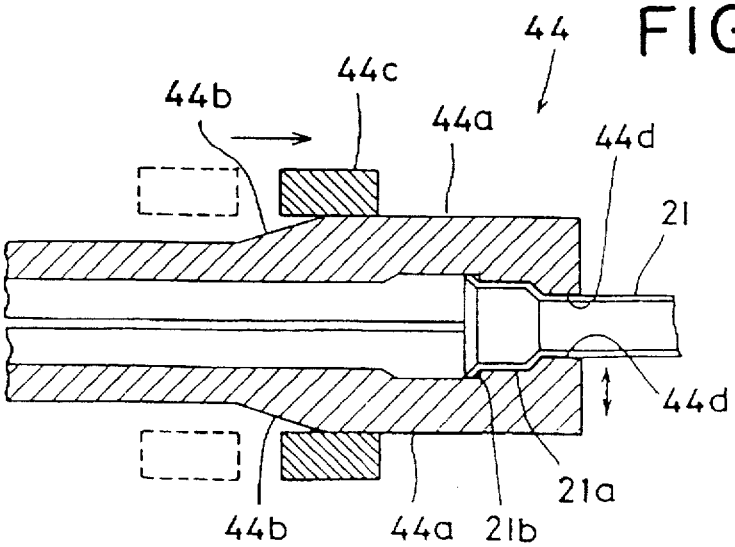
FIG. 10 is a diagrammatic sectional view showing a construction of a tube-end chuck.

FIGS. 8, 9 and 10 show a structural example of a flaring machine and a tube-end clamp equipped at the expanding unit.

The expanding unit 40 is reciprocatingly moved leftward and rightward along an edge of the stationary support 31 on one end side. A flaring machine 60 is mounted on one side of the expanding unit 40 (the front in the advancing direction) and has sleeve 61 divided in the peripheral direction, as shown in FIG. 9. The sleeve 61 has an inner surface of a tapered surface which expands gradually toward the rear end, as shown in FIG. 8. A head 62 is inserted into the sleeve from the rear. An outer surface of the head 62 is tapered correspondingly to the inner surface of sleeve 61. Accordingly, when the head 62 is inserted into the sleeve 61 from the rear, the sleeve 61 is expanded and develops from a state illustrated in the right figure into a state illustrated in the left figure in FIG. 9.

The flaring machine 60, equipped with two sleeves having the abovementioned construction, inserts the two sleeves in order into cooling tubes from the openings, so as to provide a secondary flaring process and a tertiary flaring process to the end portions of the tubes prior to the cross fin coil fixed on the stationary support 31 being tube-expansion processed. FIG. 10 shows the end portions of the cooling tubes which have undergone the secondary flaring process and the tertiary flaring process. The reference numeral 21 designates the heat exchanging tube, 21a a flaring-processed portion, and 21b a tertiary-flaring processed portion.

Tube-end chucks 44 are respectively disposed at the front of the four mandrel guides 43a of the expanding unit 40. Each tube end chuck 44 has a pair of upper and lower pawls 44a, 44a which are formed by bisecting a cylindrical member along a plane running through its center, as shown in FIG. 10. The pawls 44a, 44a have, on the outer surfaces at the intermediate portions, tapered portions 44b, 44b expanding gradually toward the leading ends. A ring 44c is fitted onto the pawls 44a, 44a. The ring 44c is advanced axially along the outside of the tapered portions 44b, 44b to close the pawls 44a, 44a, so as to chuck the end portion of the heat exchanging tube 21 which has undergone the secondary flaring process and tertiary flaring process. In order to prevent the chucked end portion of the tube from escaping, projections 44d, 44d are formed on inner surfaces of the pawls 44a, 44a at the leading end portions. With the end portions of the tubes being held by the tube end chucks, the expanding unit 40 provides the tube expansion process (primary flaring process) to the heat exchanging tubes.

Next, expanding steps will be explained hereinafter.

(1) The movable support 32 and the positioning plate 35 of the work support 30 are adjusted in position in accordance with a size of the cross fin coil to be expanded. The cross fin coil 20 is placed on the movable support 32, with the opening portions of the heat exchanging tubes of the cross fin coil 20 facing the expanding unit 40, and is fixed by clamping plates 36, 37.

(2) The expanding unit 40 is guided to an initial position where the flaring machine 60 confronts an end portion of a first heat exchanging tube of the cross fin coil 20. The secondary flaring process and the tertiary flaring process are provided to the end portion of the first heat exchanging tube by the flaring machine 60.

(3) The expanding unit 40 is driven laterally (forward in the advancing direction) by one pitch so as to bring the flaring machine 60 into confrontation with an end portion of a second heat exchanging tube. The secondary flaring process and the tertiary flaring process are provided to the end portion of the second heat exchanging tube by the flaring machine 60.

(4) The tube-end flaring process keeps on applying to the heat exchanging tubes. When the center of the first heat exchanging tube which has undergone the tube-end flaring process coincides with the center of the mandrel guide 43*a* of the expanding unit 40, the end portion of the first heat exchanging tube is held by the tube end chuck 44 disposed at the front of the mandrel guide 43*a*. It is noted that the expanding unit 40 and the flaring machine 60 are adjusted in position such that the expanding unit 40 stops at a position where the center of the heat exchanging tube coincides with the center of the mandrel guide 43*a*.

(5) Under the condition that the tube end portion of the first heat exchanging tube is chucked, the gears 43*c*, 43*c* are rotated. By the reciprocating motion of the sliders 43*b*, 43*b* caused by the rotation of the gears and the accessing and separating motion of the hitching pins 43*e*, 43*e* synchronized with the reciprocating motion of the sliders, the mandrels 10 of the universal type are fed forward from the winding drums 41 to be inserted into the heat exchanging tubes. This causes the expanding heads 13 disposed at the leading ends of the mandrels 10 to be forcibly pushed into the tube, so as to expand the tubes and fixedly secure them to the fins. At this time, the tube-end process is being provided to a heat heat exchanging tube located in front of the flaring machine 60 by the flaring machine 60.

(6) After completion of the expansion of heat exchanging tubes, the winding drums 41 are driven by the motors 42 in the direction of the mandrels being wound up, and the mandrels 10 are pulled out of the heat exchanging tubes and are wound on the winding drums 41. The four mandrels 10 may be used selectively in accordance with shape and arrangement pattern of heat exchanging tubes, so as to carry out the expansion of tube in five different ways, as mentioned above.

(7) Hereafter, whenever the expanding unit 40 is driven by one pitch, the flaring process and the expanding process to the heat exchanging tubes are carried out simultaneously and coincidently. After the flaring process to heat exchanging tube has been completed, the expanding process is provided to remaining heat exchanging tubes, so that the expanding process to cross fin coil are completed.

Although the universal type mandrels 10 are fed by the pairs of sliders 43*b*, 43*b*, in the aforementioned embodiment, means for feeding the mandrels is not limited to the sliders. Other feeding means may be used, e.g., a feeding structure in which external threads are formed on external surfaces of the mandrels 10 of the universal type and nut members are threadingly engageable with the external threads so that the nut members can be rotated to feed the mandrels.

Further, although four universal type mandrels 10 are employed by the mandrel feeding mechanism 43, in the abovementioned embodiment, the number of the mandrels is not questioned. For example, the mandrels may be inserted into the heat exchanging tubes of the cross fin coil one by one or may all be inserted at one time into all heat exchanging tubes.

Where the four mandrels 10 are arranged at the apexes of the diamond shape, such become applicable to more kinds of heat exchanging tubes, by mechanically adjusting a distance between the upper and the lower mandrels or a distance between the left and right mandrels.

Figure 11:
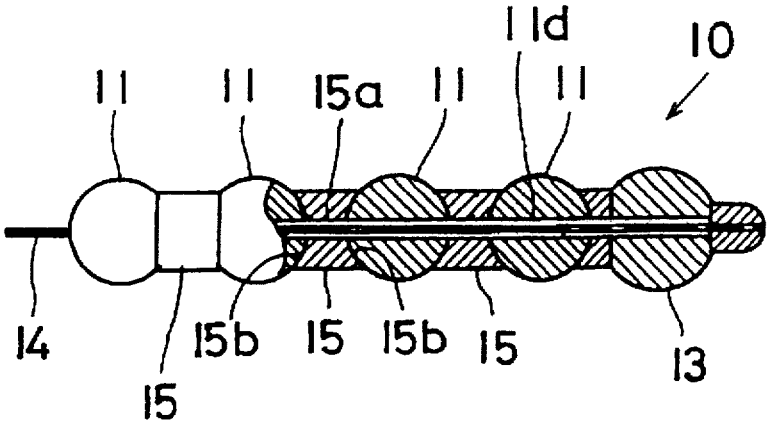
FIG. 11 is a side view partially in section showing a second embodiment of the expanding mandrel according to the present invention.
Figure 12:
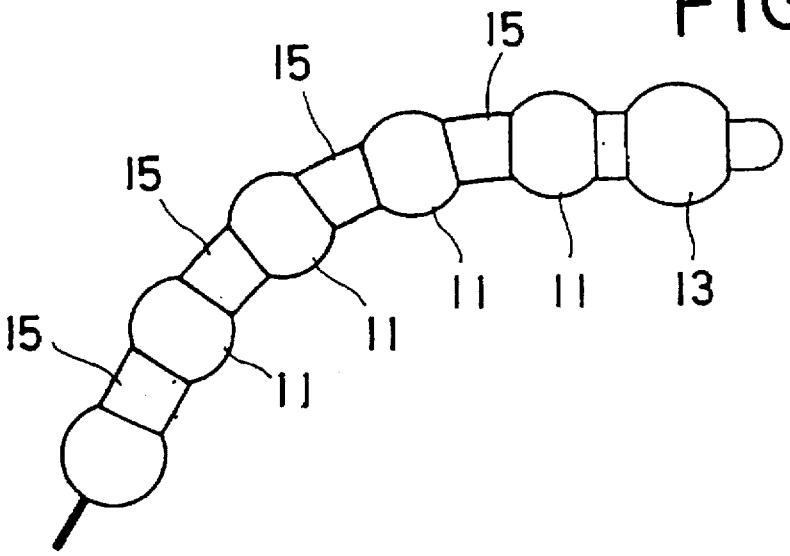
FIG. 12 is a side view showing an operational condition thereof.

Next, a second embodiment of the expanding mandrel of the present invention will be explained with reference to FIG. 11.

The mandrels 10 illustrated herein are of the rosary type each comprising a plurality of mandrel pieces 11, 11 . . . of steel balls connected in a row to one another. The mandrel pieces, each having a diametrically extending, through hole 11*d* passing through the center thereof, are connected in a row by a flexible wire 14 passing through the through holes 11*d*. A spherical expanding head 13 is connected to the leading mandrel piece 11 at the leading end side, and spacers 15 are interposed between adjacent mandrel pieces 11, 11.

The expanding head 13 has a larger diameter than an inner diameter of the heat exchanging tube of the cross fin coil to be expanded and is connected to the leading end of the wire 14. Also, the diameter of the mandrel piece 11 is set to be smaller than the inner diameter of the heat exchanging tube. Each spacer 15 is formed of a cylinder having an even smaller diameter than that of the mandrel piece 11 and has at the center a through hole 15*a* for the wire to pass therethrough. Also, the spacer 15 has, on the opposite end surfaces, spherical seats 15*b*, 15*b* to contact with the mandrel pieces 11, 11 on surfaces.

This rosary type mandrel 10 not only has flexibility but also bends more smoothly. Further, it can easily get a smaller radius of curvature than the universal type mandrel. Accordingly, the rosary type mandrel is especially suitable to the expanding process to the cross fin coil of the L-shaped type or the U-shaped type.

Figure 13:
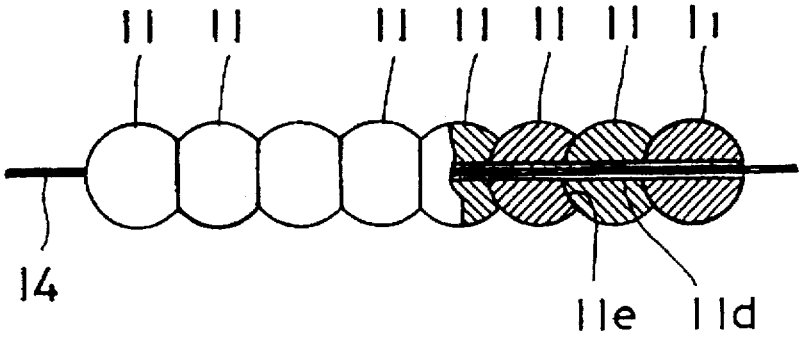
FIG. 13 is a side view partially in section showing a third embodiment of the expanding mandrel according to the present invention.

The spacers 15 interposed between adjacent mandrel pieces 11, 11 restrain partial wear of the mandrel pieces 11, 11 . . . . Instead of the spacers 15, spherical seats 11*e* may be formed in the mandrel pieces 11, as in a third embodiment shown in FIG. 13.

Next, a second of the expanding apparatus of the present invention will be explained with reference to FIGS. 14 through 21.

Figure 14:
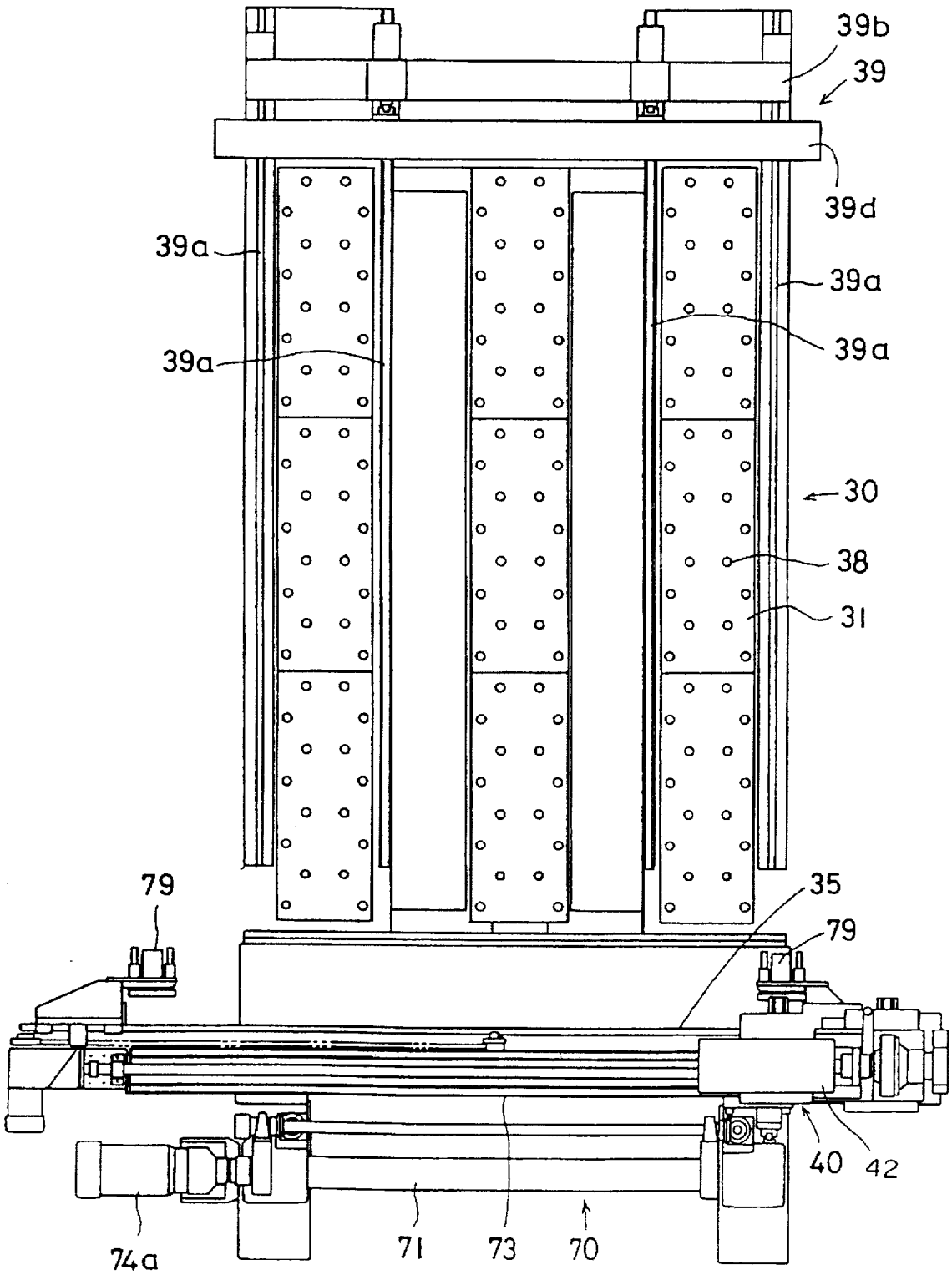
FIG. 14 is a plan view showing a second embodiment of the expanding apparatus according to the present invention.
Figure 15:
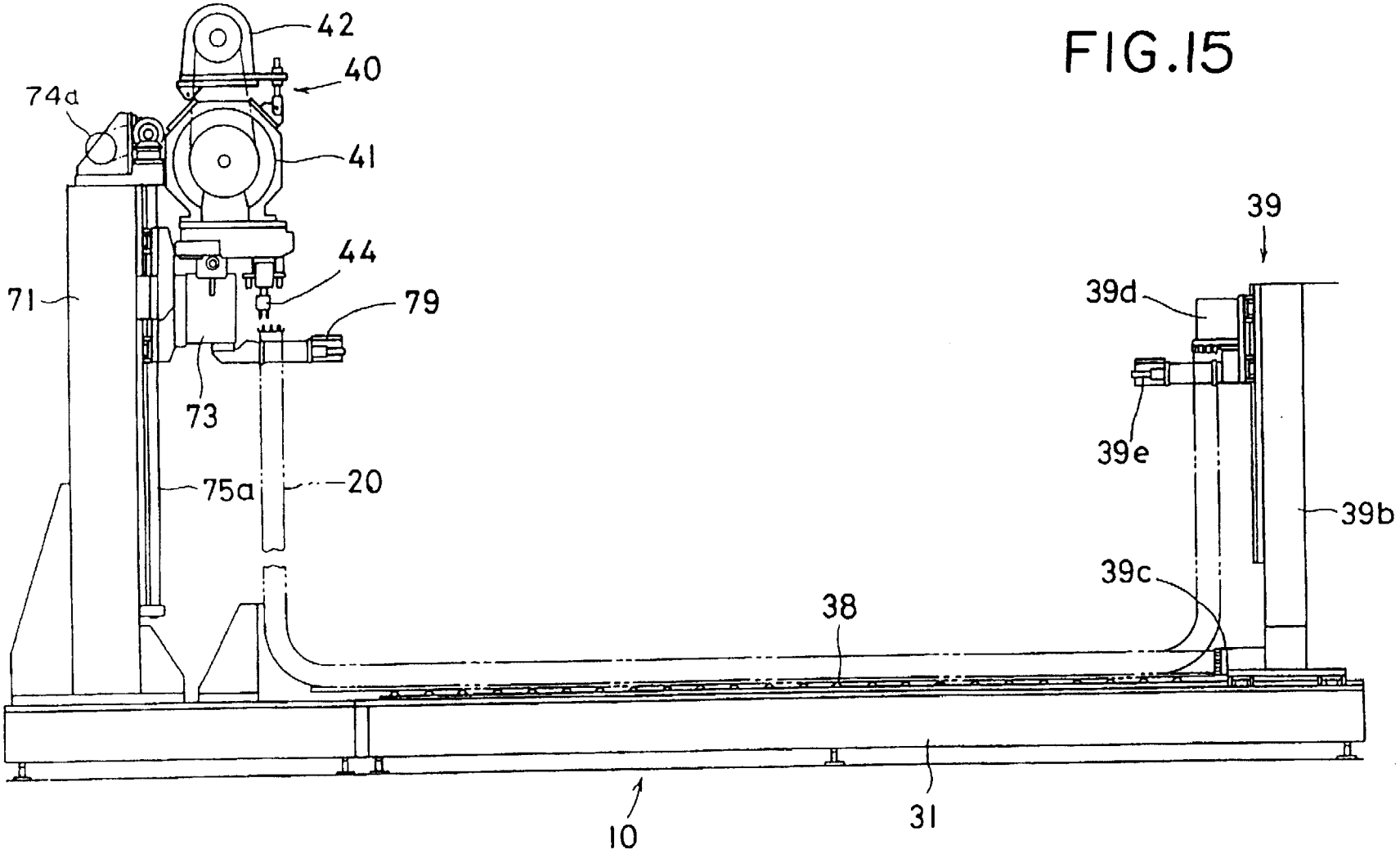
FIG. 15 is a side view thereof.
Figure 16:
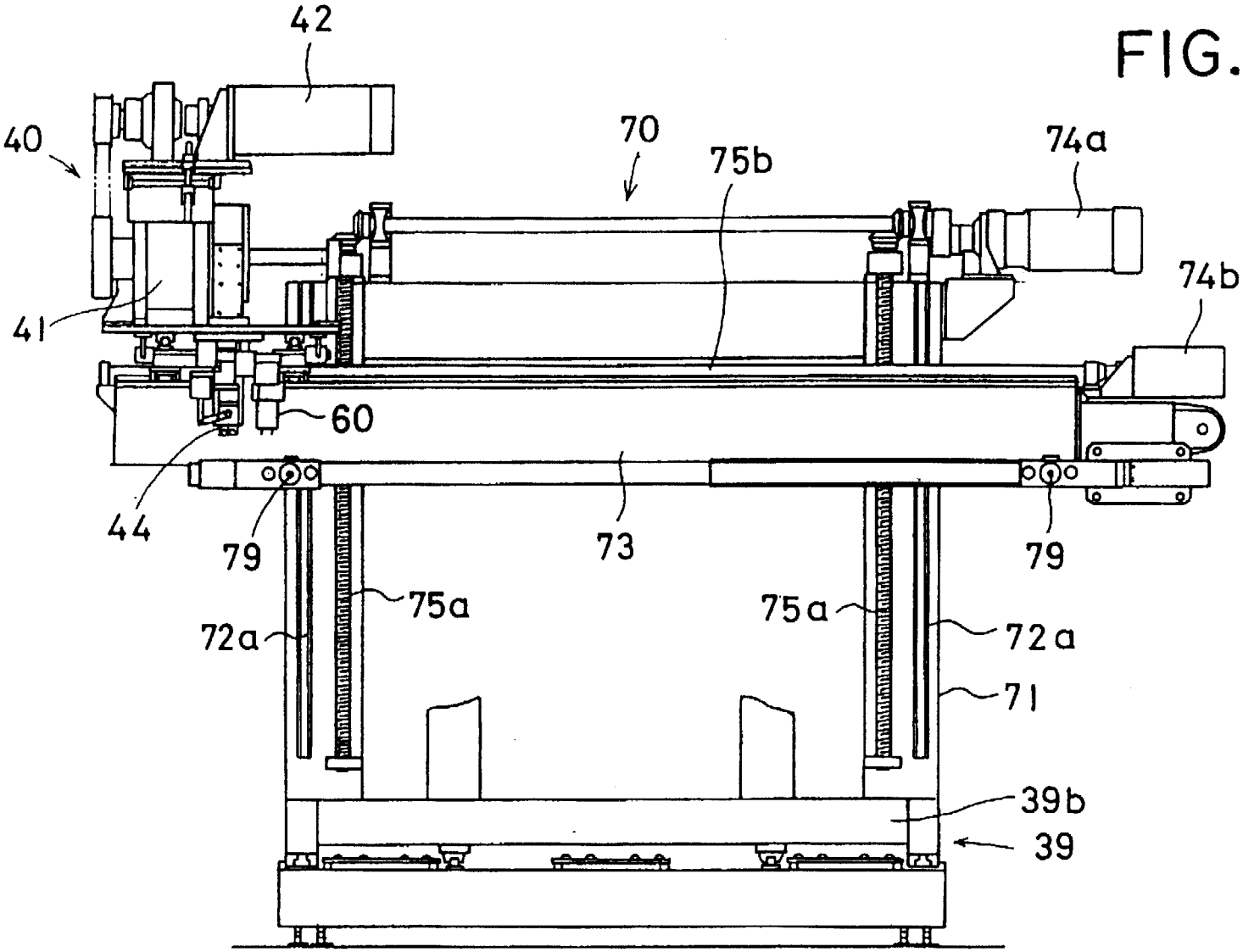
FIG. 16 is a front view thereof.

The expanding apparatus illustrated herein is for performing the tube expanding process to the cross fin coil 20 of the L-shaped type or the U-shaped type by using the aforementioned rosary type mandrels 10. A basic structure of this expanding apparatus, as shown in FIGS. 14 through 16, comprises a work support 30 for supporting and fixing the cross fin coil 20 and an expanding unit 40 disposed on one end side of the work support 30, as the same as in the first embodiment. Elements having the same construction as those of the first embodiments are designated by the same reference numerals.

The work support 30 is so structured as to move the cross fin coil 20 horizontally by a plurality of balls 38 arranged on surfaces of horizontal fixing supports 31 and also position the cross fin coil 20 at a processing position via a positioning plate 35 disposed at the one end portion thereof.

The cross fin coil 20 used is of the L-shaped type or the U-shaped type as mentioned above. In the L-shaped type cross fin coil illustrated in FIG. 24, the straight tube portions of the hairpin-shaped heat exchanging tube 21 are bent at a right angle at the intermediate portions. In the U-shaped cross fin coil illustrated in FIG. 25, the straight portions of the hairpin-shaped heat exchanging tubes are bent at a right angle at two locations at the intermediate portions. Any type of the cross fin coil 20 is positioned on the work support 30, with the opening ends of the straight tube portions of the heat exchanging tubes facing one end side of the work support 30. The opening end portions are clamped by a pair of chucks 79, 79 attached to an elevator 73, which is explained later, and the other end portions are fixedly secured by a fixing mechanism 39 disposed at the other end portion of the work support 30.

The fixing mechanism 39 has a movable carriage **39*b* which is moved in the longitudinal direction of the work support 30 under guidance of guides 39*a*. A fixing plate 39*c* for fixing the other end portion of the L-shaped type cross fin coil 20 by a pushing force is mounted to a front surface of the movable carriage 39*b*** at the lower end.

An elevatory beam **39*d* which moves up and down along the movable carriage 39*b* is arranged above the fixing plate 39*c*. A pair of chucks 39*e*, 39*e* are mounted on a lower surface of the elevatory beam 39*d*. The chucks 39*e*, 39*e* serve to hold the other end portion of the U-shaped type cross fin coil 20. A vertical position of the chucks is adjusted by moving up and down the elevatory beam 39*d*, and a distance between the chucks is adjusted by moving one chuck laterally along the lower surface of the elevatory beam 39*d***.

The expanding unit 40 disposed on one side of the work support 30 is driven triaxially by a driving mechanism 70. The driving mechanism 70 is provided with a fixing support 71 and an elevatory base 73 which is movable up and down under guidance of vertical guides **72*a*, 72*a* mounted on the front surface of the support 71. The elevatory base 73 is moved up and down by rotations of a pair of vertical screws 75*a*, 75*a* driven by a motor 74*a* mounted to the fixing support 71**.

Figure 17:
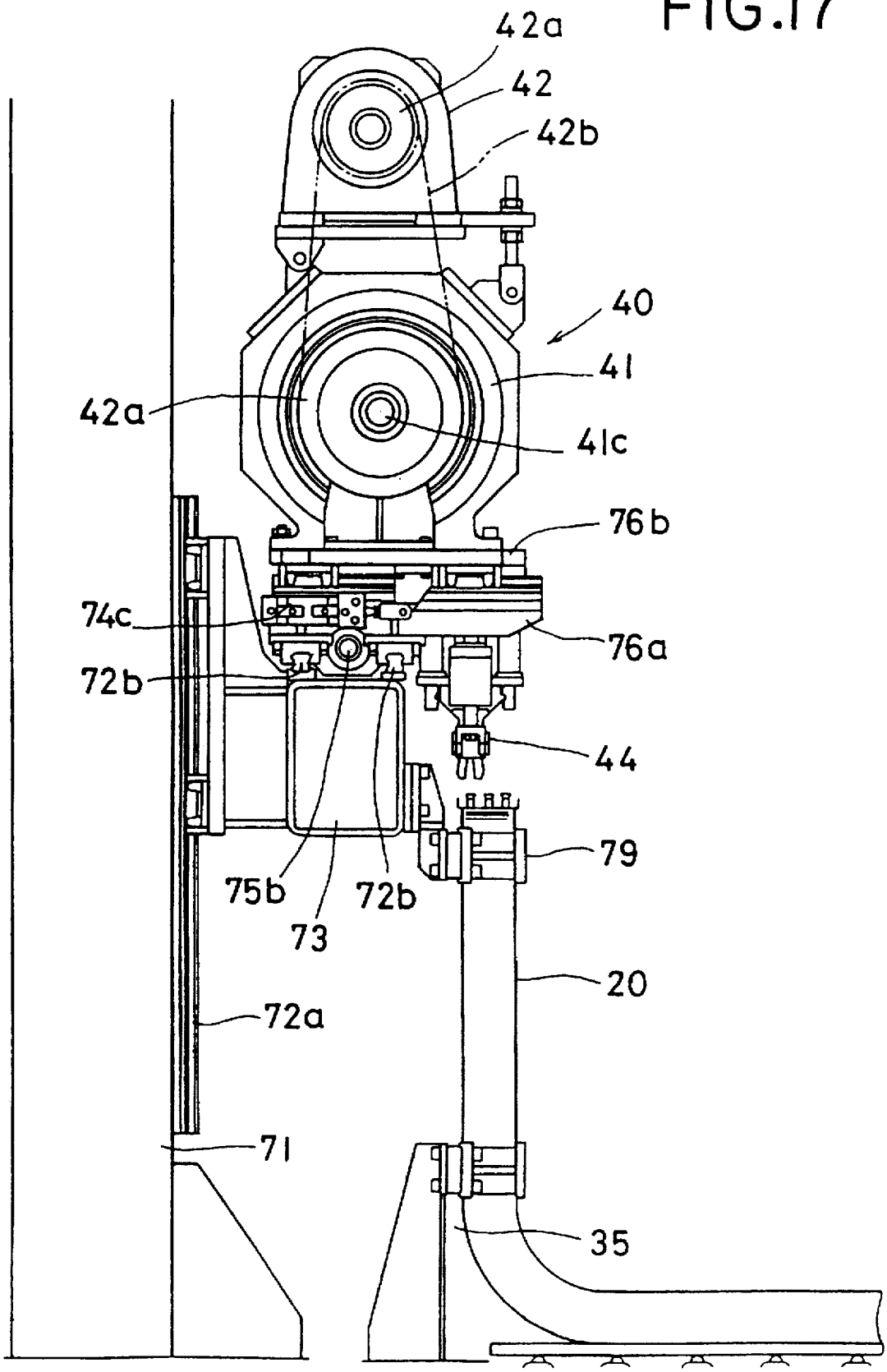
FIG. 17 is an enlarged side view of a portion of an expanding unit.
Figure 18:
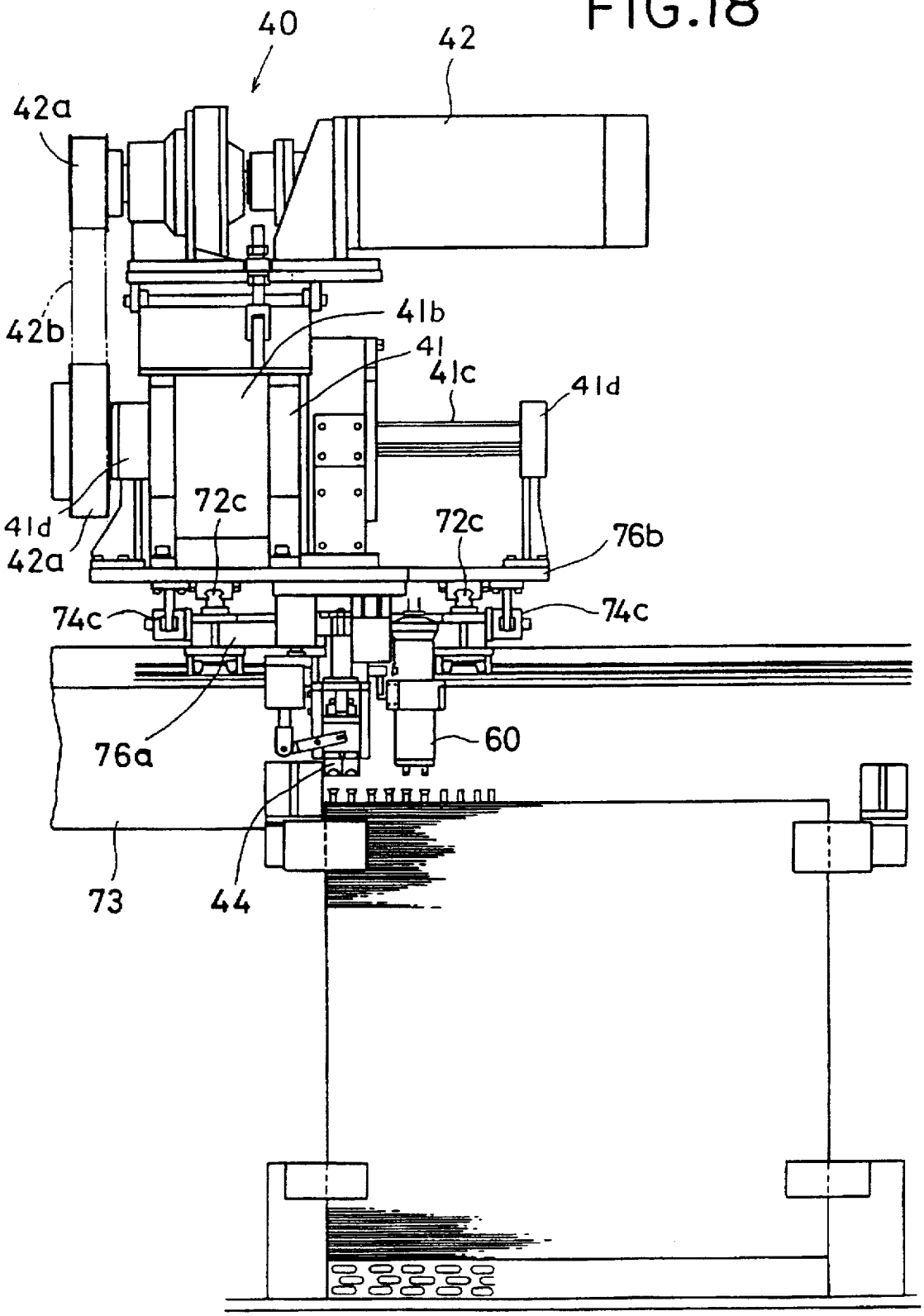
FIG. 18 is an enlarged front view of the portion of the expanding unit.

Slide bases **76*a*, 76*a* are arranged one above the other on the elevatory base 73, as shown in FIGS. 17 and 18. The lower slide base 76*a* is moved (laterally) on the elevatory base 73 in the longitudinal direction (in the widthwise direction of the work support 30), under guidance of horizontal guides 72*b*, 72*b*, by the rotation of a horizontal screw 75*b* driven by a motor 74*b* mounted to an end portion of the elevatory base 73. The upper slide base 76*b* is moved back and forth on the lower slide base 76*a*, under the guidance of horizontal guides 72*c*, 72*c*, by linear motors 74*c*, 74*c* arranged at both sides, as shown in FIG. 18. The expanding unit 40 is disposed on the upper slide base 76*b*. Thus, the expanding unit 40 can be driven triaxially by the vertical movement of the elevatory base 73 and the lateral movement and the back-and-forth movement of the slide bases 76*a*, 76*a***.

Figure 19:
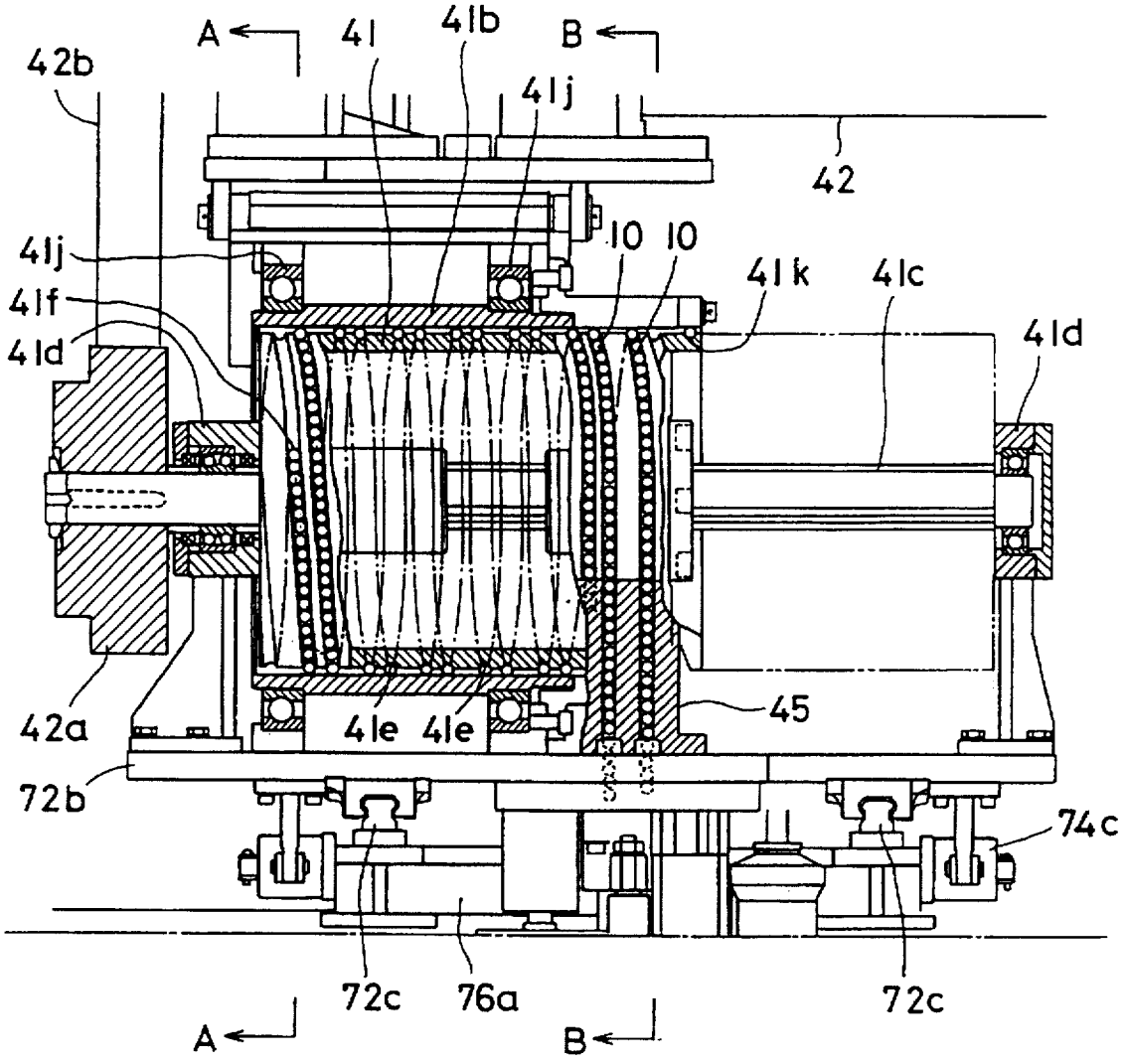
FIG. 19 is a front view of a principal portion including a sectional winding drum and a sectional sheath.

The expanding unit 40 includes a winding drum 41 which doubles as a mandrel feeding mechanism in the first embodiment. As shown in FIG. 19, the winding drum 41 is provided around its outer peripheral portion with a sheath **41*b* concentrically assembled to the winding drum 41. The winding drum 41 is so supported by a horizontal spline shaft 41*c* as to be axially movable. The spline shaft 41*c* is rotatably supported by bearings 41*d*, 41*d* at the opposite ends and is rotationally driven by rotation of a motor 42 mounted on the winding drum 41 being transmitted thereto via pulleys 42*a*, 42*a* and a belt 42*b*, as shown in FIG. 18. The winding drum 41 is rotated synchronously with the rotation of the spline shaft 41*c***.

Figure 20:
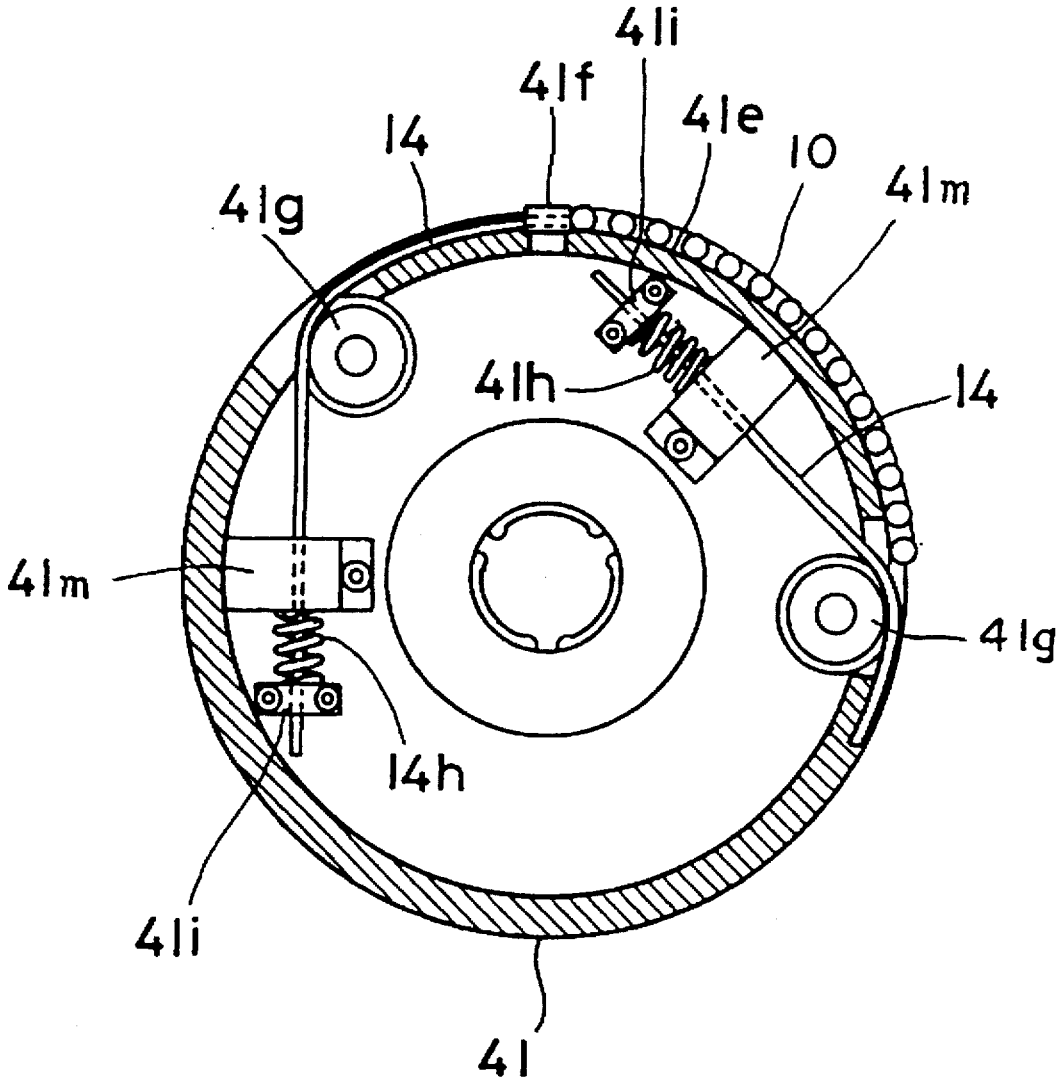
FIG. 20 is a sectional view of only the winding drum taken along line A—A line of FIG. 19.

Two spiral grooves **41*e*, 41*e* of U-shape in cross section, in which the mandrels 10 of the abovementioned rosary type engage, are formed in parallel on the outer peripheral surface of the winding drum. The two mandrels 10, 10 are spirally positioned from one ends to the other ends by the spiral grooves 41*e*, 41*e* on the outer peripheral surface of the winding drum 41 and are spirally wound and accomodated along the grooves. As shown in FIG. 20, each spiral groove 41*e* is provided at its one end portion with a stopper 41*f* engageable with the last mandrel piece 11 of the plurality of mandrel pieces of the mandrel 10. A rear end portion of the wire is, as shown in FIG. 20, guided into the winding drum 41 through a guide roller 41*g*, and is fastened to a wire end fitting 41*i*. Between the wire end fitting 41*i* and a fixture 41*m* fixed to the drum 41, there is interposed a resilient member 41*h* of a coil spring for pulling the rear end portion of the row of the mandrel pieces to bring it into resilient contact with the stopper 41*f***.

Figure 21:
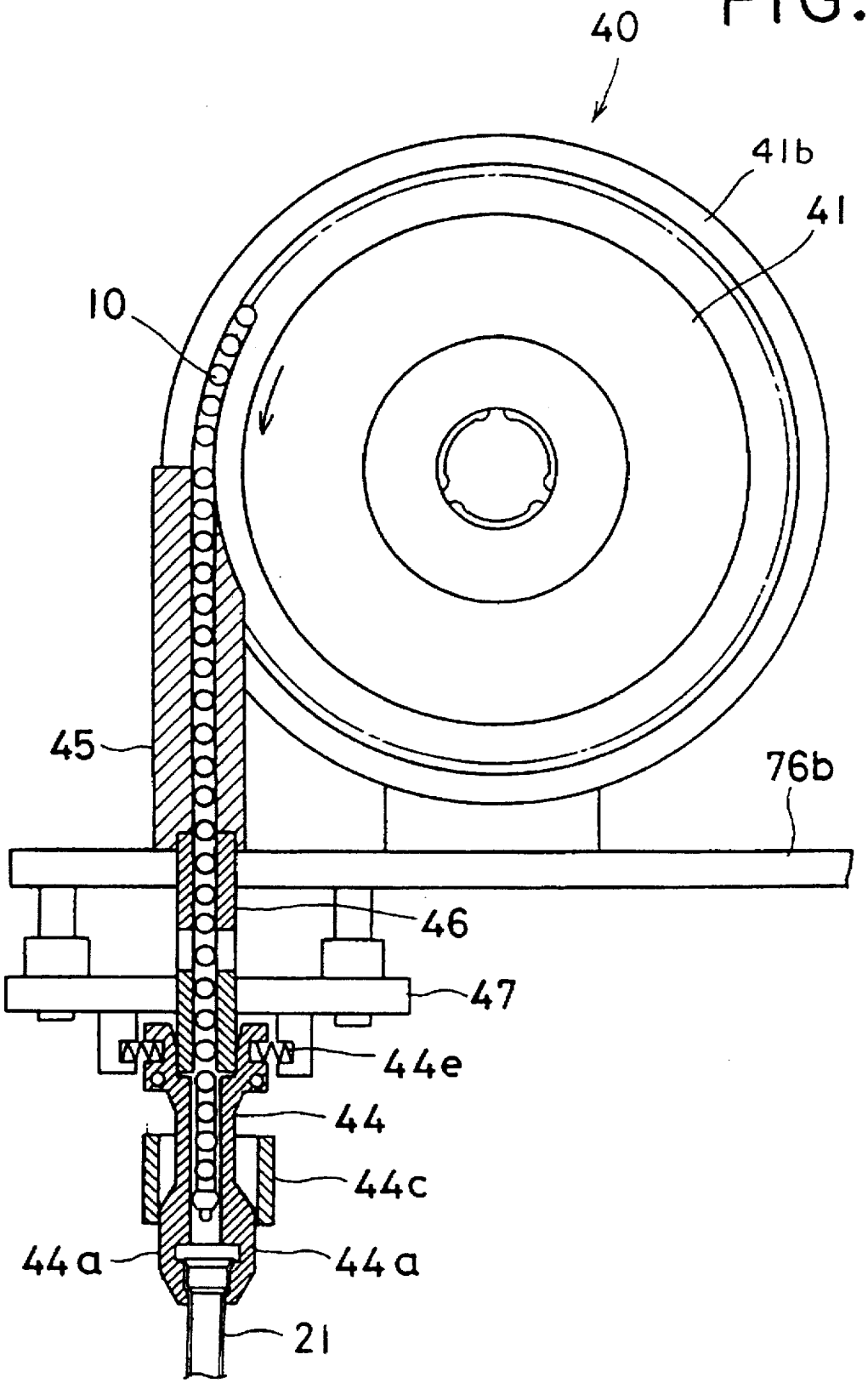
FIG. 21 is a side view including a sectional mandrel guide and a sectional chucking mechanism taken along line B—B of FIG. 19.
Figure 22:
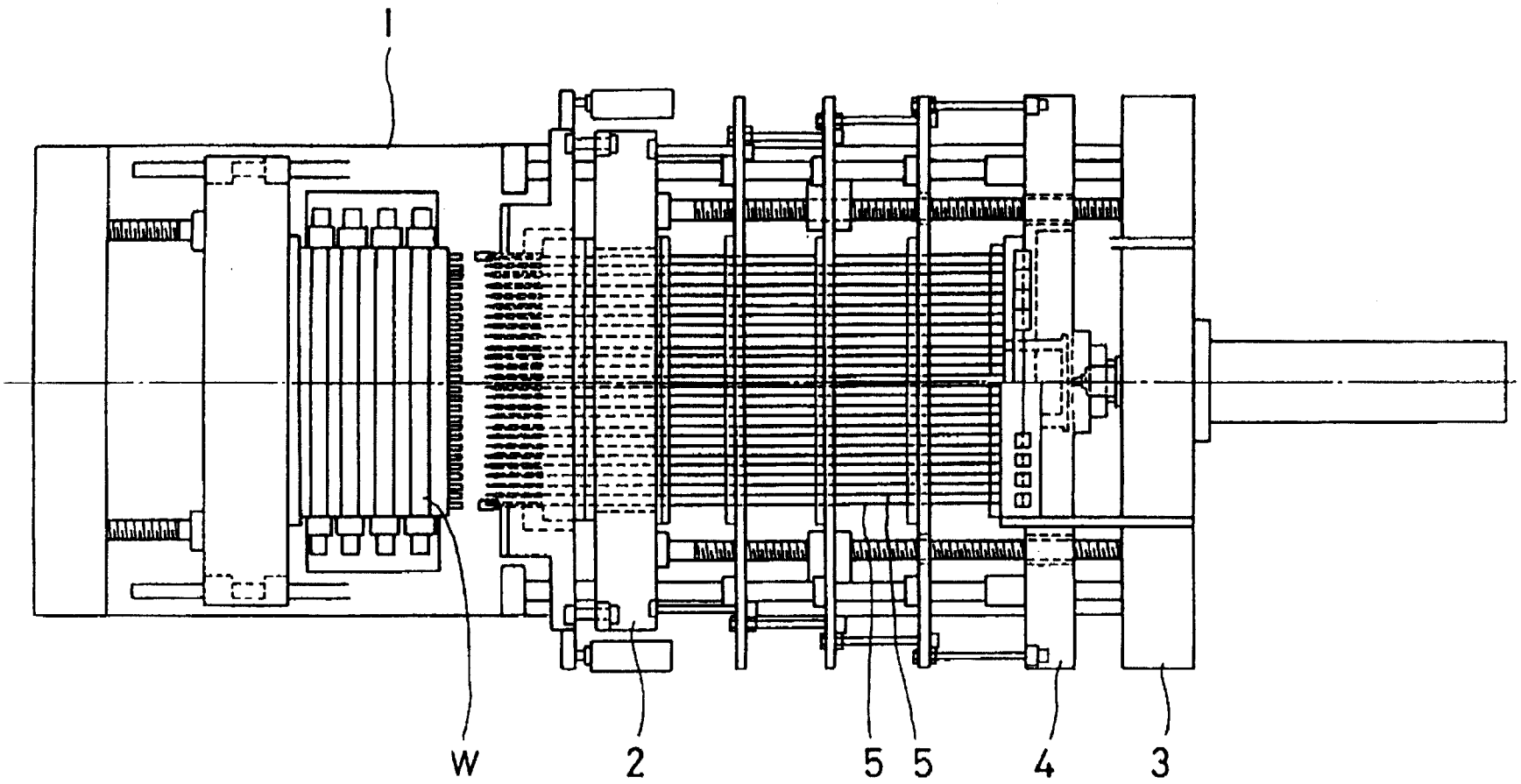
FIG. 22 is a plan view of a conventional expanding apparatus.
Figure 23:
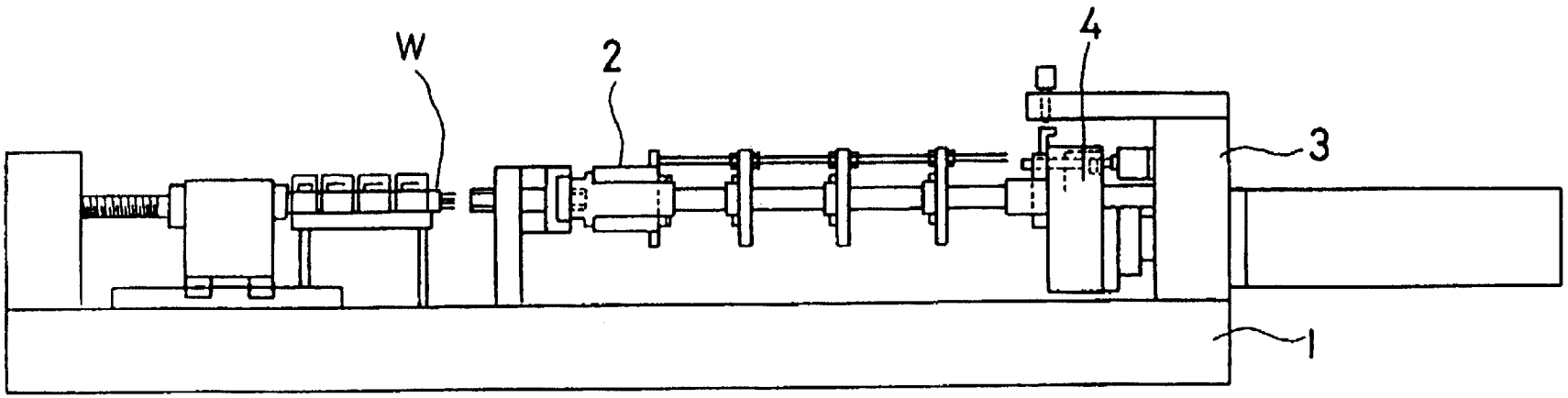
FIG. 23 is a side view the conventional expanding apparatus.

On the other hand, the leading end portions of the mandrels 10 are drawn out downwards from the other end portions of the spiral grooves **41*e* through a vertical, tubular, tandem type mandrel guide 45, as shown in FIG. 21. The mandrel guide 45 is disposed at the mandrel entrance/exit portion of the winding drum 41 and is fixed on the slide base 76*b***.

The sheath **41*b* serves to hold the mandrels 10, 10 wound on the winding drum 41 from the outside and is disposed around the outer peripheral portion of the winding drum 41, forming a gap therebetween for occupancy of the mandrels 10, 10. Also, the sheath 41*b* is supported at the opposite ends by bearings 41*j*, 41*j* and is rotatable together with the winding drum 41. A lead 41*k* is provided at the other end portion of the sheath 41*b* (mandrel-pulling-out side) at the frame side of the expanding unit 40. The lead 41*k* is formed of a rotatable steel ball. It is located on the other end portion of an internal cylinder 41*a* and is in engagement with the other end portion of the spiral groove 41*e***.

When the winding drum 41 rotates, the spiral groove **41*e* is led by the lead 41*k* and the winding drum 41 moves axially along the spline shaft 41*c*, while rotating. The pitch of the drum 41 moving spirally is the same as that of the mandrels 10, 10 being wound on the drum 41. Thus, the two mandrels 10, 10 wound on the winding drum 41 are moved to other end side or to the mandrel entrance/exit side at which the mandrel guide 45 is located, by rotation of the drum 41, and thereby they are pushed by the stoppers 41*f* and also are restrained from deviating outwardly by the sheath 41*b*, so as to be pushed downwards out of the stationary, tandem type mandrel guide 45**.

Under the stationary tandem type mandrel guide 45, a tandem type tube-end chuck 44 is disposed vertically via an extendable mandrel guide 46, as shown in FIG. 21. The tube-end chuck 44 is mounted on a lower surface of a support plate 47 movable up and down and is elevatingly driven by a cylinder 48 (FIGS. 17, 18). The tube-end chuck 44 has basically the same structure as the aforementioned tube-end chuck provided at the expanding apparatus (FIG. 10) and operates to chuck a flaring processed end portion of the heat exchanging tube 21 by moving down a ring **44*c* to close a pair of pawls 44*a*, 44*a* opened by he springs 44*e***.

A tandem type flaring machine 60 for flaring the end portions of the heat exchanging tube 21 is disposed at the lateral side of the tube-end chuck 44 or at the front in the movement direction of the slide bases 76*a*, 76*a*, as shown in FIGS. 16 and 18, so as to perform the flaring process, prior to the expanding process. The flaring machine 60 has basically the same structure as the aforementioned flaring machine disposed at the expanding apparatus (FIGS. 8, 9).

Next, expanding steps using the expanding apparatus of the second embodiment will be explained.

The cross fin coil 20 to be expanded is fixedly secured on the work support 30. Then, the expanding unit 40 is moved to provide the flaring process to the end portions of the heat exchanging tubes 21 by twos from one end by use of the flaring machine 60, and also provides the expanding process to the flaring processed expanding tubes 21 by twos by use of the expanding unit 40. The basic operation is substantially the same as that of the aforementioned expanding apparatus of the first embodiment, except an operation for inserting mandrels 10, 10 which will be explained hereinafter.

When the tandem type tube-end chuck 44 is situated above the respective end portions of the two heat exchanging tubes 21, 21, the tube end portions are fixed by the tube-end chuck 44. At this time, the two mandrels 10, 10 are still in the wound state on the winding drum 41.

After the end portions of the two heat exchanging tubes 21, 21 are fixed by the chuck 44, the motor 42 is started to rotate the spline shaft 41*c*. The winding drum 41 is thus moved axially, while rotating, toward the other end side (or toward the mandrel guide). As a result, the two mandrels 10, 10 wound around the outer peripheral surface of the winding drum 41 are pushed by the stopper 41*f* and are pushed out downward in order from the mandrel guide 45 disposed at the other end portion of the winding drum 41. Thereupon, the sheath 41*b* prevents outward deviations of the two mandrels 10, 10 wound on the winding drum 41, so as to transmit a thrusting force applied to the last mandrel pieces 11 to the expanding heads 13 without loss.

The entrance/exit portion, via which the mandrels 10, 10 is pushed out downwards from a space between the winding drum 41 and the sheath 41*b*, changes in position due to its axial movement associated with the rotation of the winding drum 41, while the two mandrels 10, 10 are pushed out of the entrance/exit portion into the heat exchanging tubes 21, 21, passing through the stationary tandem-type mandrel guide 45, the extendable tandem-type mandrel guide 46 and the tandem-type tube-end chuck 41. Thus, the heat exchanging tubes 21 are expanded at the same time and in a short time and are fixedly secured to the fins.

The two mandrels 10, 10 of the rosary type can bend smoothly with a small radium of curvature, and so they can pass through bend portions of the heat exchanging tubes 21, 21 smoothly. Therefore, whether the cross fin coil 20 is of the L-shaped type or the U-shaped type, the expanding process can be performed without any problem. When the mandrels 10 bend, they vary in length, but this variation in length can be accomodated by springs 41*h* at the winding drum 41.

When the mandrels 10, 10 inserted into the heat exchanging tubes 21, 21 reach the ends of the straight tube portions thereof, the motor 42 is reversely rotated. Due to this, the winding drum 41 is returned to the initial position, while rotating reversely, so that the two mandrels 10, 10 are wound again along the spiral grooves 41*e* of the winding drum 41, for storage. Then, the tube-end chuck 44 is moved up with being opened to expand the next two heat exchanging tubes 21, 21 and then the expanding unit 40 is moved by a stroke corresponding to the distance between the heat exchanging tubes.

Figure 24:
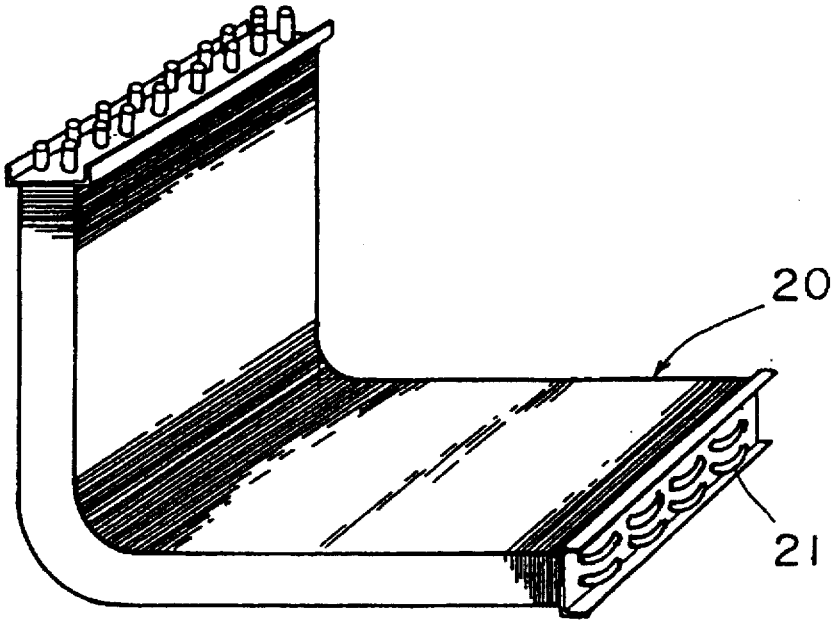
FIG. 24 is a perspective view of a cross fin coil of the L-shaped type.
Figure 25:
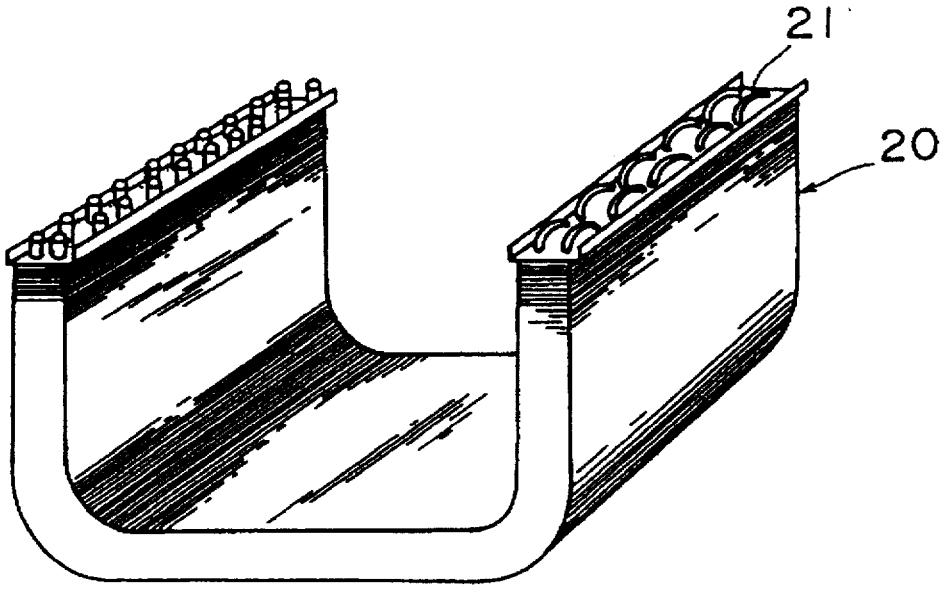
FIG. 25 is a perspective view of a cross fin coil of the U-shaped type.

The slide bases 76*a*, 76*b* of the expanding unit 40 are advanced at established pitches in the axial direction of the winding drum 41 with respect to the elevatory support 73, so that the plurality of heat exchanging tubes 21 are expanded, as shown in FIGS. 24 and 25, with good efficiency, thus providing improved workability.

Although it is preferable that the sheath 41*b* is rotatable together with the winding drum 41 in the abovementioned second embodiment, the sheath 41*b* may be fixed.

Further, the axial movement of the winding drum 41 may be provided by a bowl screw shaft, instead of the spline shaft 41*c*.

Further, although the expanding unit 40 employs two mandrels 10, 10 in this embodiment, it may be so structured as to have four mandrels 10 which are activated simultaneously in the same manner as in the aforementioned expanding apparatus of the first embodiment. The number of the mandrels used is not limited.

INDUSTRIAL APPLICABILITY

The expanding mandrel, the expanding method and the expanding apparatus both using the expanding mandrel according to the present invention are mainly applied to expansion of heat exchanging tubes of a cross fin coil of an air conditioning machine, while also they can be widely applied to expansion of metal tubes, such as a copper tube, for connection with another metal plate or metal tube, especially, serving a useful function to expansion of metal tubes having bent portions.

We claim:

1. A flexible expanding mandrel for expanding a tube from an open-end thereof over a length of said tube comprising a plurality of mandrel pieces which are formed of spherical members having diametrically extending through-holes formed therein for insertion into a tube to be expanded, and between adjacent mandrel pieces there are interposed spacers each having a central through-hole, each said spacer having at its opposite ends spherical seats with which the mandrel pieces make surface contact, said mandrel pieces and spacers being connected in a row by a wire passing through the through-holes in such a manner as to be bendable at connecting portions between said mandrel pieces and said spacers, said mandrel having a leading end with an expanding head.

2. An expanding apparatus using a flexible expanding mandrel, said flexible expanding mandrel comprising a plurality of mandrel pieces for insertion into a tube to be expanded, said mandrel pieces being connected in a row in such a manner as to be bendable at connecting portions between said mandrel pieces and having a leading end with an expanding head for expansion of tubes, said expanding apparatus comprising a winding drum for winding thereon the flexible expanding mandrel, and a mandrel feeding mechanism for applying a longitudinal thrusting force to the flexible expanding mandrel to forcibly insert said expanding head into the tube.

3. An expanding apparatus at set forth in claim 2 including a work support on which a cross fin coil to be expanded is fixedly secured, and an expanding unit equipped with the winding drum and the mandrel feeding mechanism is arranged to be reciprocatingly movable relative to the tubes of the cross fin coil which is fixedly secured on the work support.

4. An expanding apparatus as set forth in claim 3, wherein said expanding unit employs four mandrels, and feeding passages for the four mandrels are arranged at four apexes of a diamond figure.

5. An expanding apparatus as set forth in claim 2 wherein the mandrel feeding mechanism is attached to the winding drum and comprises a mandrel guide for guiding the mandrel linearly; a pair of sliders mounted for synchronous reciprocating motion in opposite directions along the mandrel guide and moved by a pair of crank mechanisms; movable hitching pins which are provided at the sliders and are movable perpendicularly to the mandrel guide so as to fit into concave portions of the mandrel pieces in the mandrel guide.

6. An expanding apparatus using a flexible expanding mandrel, said flexible expanding mandrel comprising a plurality of mandrel pieces for insertion into a tube to be expanded, said mandrel pieces being connected in a row in such a manner as to be bendable at connecting portions between said mandrel pieces and having a leading end with an expanding head for expansion of tubes, said expanding apparatus comprises (i) a winding drum which has a spiral groove for winding and unwinding the flexible expanding mandrel so the flexible expanding mandrel wound along the spiral groove may be fed from a mandrel entrance/exit portion of the winding drum by the normal rotation thereof and the flexible expanding mandrel may be wound along the spiral groove by a reverse rotation thereof and (ii) a mandrel guide disposed at the mandrel entrance/exit portion of the winding drum, the winding drum being provided around its outer peripheral portion with a sheath for covering said spiral-groove region except the mandrel entrance/exit portion.

7. An expanding apparatus as set forth in claim 6 wherein the sheath is supported to rotate together with the winding drum.

8. An expanding apparatus as set forth in claim 6 wherein the winding drum is provided with (i) a stopper engageable with an end portion of an array of the mandrel pieces of the mandrel wound along the spiral groove and (ii) a resilient member for pulling an end of a wire passed through the mandrel pieces to bring the end portion of the array of the mandrel pieces into resilient contact with the stopper.

9. An expanding apparatus as set forth in claim 6 comprising (i) slide bases which support the winding drum, the sheath and the mandrel guide for reciprocatory motion in the axial direction of the winding drum with respect to a basal support, and (ii) a driving mechanism for moving the slide bases forwardly.

10. A method for expanding a tube from an open end thereof over a length of said tube by use of a flexible expanding mandrel comprising a plurality of mandrel pieces for insertion into a tube to be expanded, said mandrel pieces being connected in a row in such a manner as to be bendable at connecting portions between said mandrel pieces and having a leading end with an expanded head which has an outer diameter larger than an inner diameter of a tube to be expanded, said method comprising forcibly inserting said leading end into a tube by applying a thrusting force from outside of said tube to said mandrel; withdrawing the mandrel from the tube; winding up the withdrawn mandrel onto a winding drum.

* * * * *